US006098555A

United States Patent [19]

Sakuma

[11] Patent Number: 6,098,555

[45] Date of Patent: Aug. 8, 2000

[54] CHAIN-OFF FORMING APPARATUS FOR COVER STITCH SEWING MACHINES

[75] Inventor: Kouichi Sakuma, Yamagata, Japan

[73] Assignee: Suzuki Manufacturing Co., Ltd., Japan

[21] Appl. No.: 09/362,030

[22] Filed: Jul. 28, 1999

[30] Foreign Application Priority Data

Sep. 22, 1998 [JP] Japan ..... 10-268329

[51] Int. Cl.[7] ..... D05B 1/10; D05B 61/00

[52] U.S. Cl. ..... 112/165; 112/197; 112/260

[58] Field of Search ..... 112/288, 165, 112/260, 197, 187, 199, 200

[56] References Cited

U.S. PATENT DOCUMENTS

| | | | |
|---|---|---|---|
| 3,908,569 | 9/1975 | Ketterer | 112/197 |
| 4,186,676 | 2/1980 | Villa et al. | 112/165 |
| 4,480,562 | 11/1984 | Von Hagen et al. | 112/165 X |
| 4,791,874 | 12/1988 | Shiomi | 112/260 X |
| 4,934,293 | 6/1990 | Yokota et al. | 112/288 |
| 5,027,728 | 7/1991 | Prina | 112/197 |
| 5,503,094 | 4/1996 | Tseng | 112/165 X |

FOREIGN PATENT DOCUMENTS

| | | |
|---|---|---|
| 395653 | 3/1939 | Japan . |
| 57-58191 | 12/1982 | Japan . |
| 61-25754 | 8/1986 | Japan . |
| 323887 | 1/1991 | Japan . |
| 5237275 | 9/1993 | Japan . |
| 5300991 | 11/1993 | Japan . |
| 6182079 | 7/1994 | Japan . |
| 78667 | 1/1995 | Japan . |
| 7275546 | 10/1995 | Japan . |
| 9285666 | 11/1997 | Japan . |

*Primary Examiner*—Ismael Izaguirre
*Attorney, Agent, or Firm*—Lorusso & Loud

[57] ABSTRACT

A needle plate of a cover stitch sewing machine, adapted to introduce double chain stitch chain-off's, which are formed below a needle plate by the intertwining of threads on three needles and a thread on a looper in accordance with actions of the needles and looper occurring when fabrics to be sewn are not fed, onto the portion of an upper surface of the needle plate which is behind needle points, and feed out the chain-off's continuously with the chain-off's held between rear feed dogs on the rear side of the needle points and a chain-off thread gripper, is provided with a thread positioning spreader formed of retainers 10A, 10B having inclined portions indexed to the needle points and provided between recesses of the needle plate so that the chain-off stitches can be sewn continuously in a stable condition by a simple structure.

5 Claims, 23 Drawing Sheets

CHAIN-OFF FORMING APPARATUS FOR COVER STITCH SEWING MACHINES

BACKGROUND OF THE INVENTION

1. Field of the Invention

This invention relates to a chain-off forming apparatus for cover stitch sewing machines, and more particularly to a chain-off forming apparatus for cover stitch sewing machines, adapted to continuously form chain-off stitches knitted out by needle threads and a looper thread.

2. Description of the Related Art

In a conventional sewing machine for forming double chain stitches and cover stitches by a plurality of needles and one looper, the forming of chain-off stitches is required so as to cut and draw out a sewing thread by which subsequent fabrics are sewn after the sewing of preceding fabrics has been finished. For example, in a cover stitch sewing machine, such chain-off stitches are formed by knitting out needle threads and a looper thread by only the needles and a looper under a needle plate after the fabrics have been sent out and left a sewing position.

Such chain-off stitches drawn out by feed dogs are not engaged with any part until they have been held between an upper surface of the needle plate and a lower surface of a pressure foot. A chain-off stitch formed at a rear end of the fabrics is shaked off due to the vertical movements of the needle and the arcuate reciprocating movements of the looper. Consequently, a skip occurs, and the forming of continuous, normal chain-off stitches becomes impossible, so that there is a fear of entanglement of the threads in the looper and breakage of the threads.

In order to eliminate these difficulties, a needle plate and feed dogs for intermittent sewing work (Japanese Utility Model Publication No. 5653/1964), an apparatus for forming stitch chains by a two-needle type sewing machine (Japanese Patent Publication No. 58191/1982), a needle plate for hemstitch sewing machines (Japanese Utility Model Publication No. 25754/1986), a thread loop forming apparatus for multi-needle loop stitch sewing machines (Japanese Patent Laid-Open No. 23887/1991), an apparatus for forming double chain stitches, and feed dogs and a needle plate therefor (Japanese Patent Laid-Open No. 237275/1993), a method of and an apparatus for drawing out chain-off's by a two-needle and three-thread sewing machine, and a chain-off (Japanese Patent Laid-Open No. 300991/1993), a chain-off forming apparatus for cover stitch sewing machines (Japanese Patent Laid-Open No. 182079/1994), a double chain stitch sewing machine (Japanese Patent Laid-Open No. 8667/1995), a multi-needle double chain stitch sewing machine (Japanese Patent Laid-Open No. 275546/1995) and a thread control apparatus for double chain stitch sewing machines (Japanese Patent Laid-Open No. 285666/1997) were proposed.

(1) The needle plate and feed dogs for intermittent sewing work disclosed in Japanese Utility Model Publication No. 5653/1964 comprise two-group feed dogs, a lateral frame formed between holes made in the needle plate for the two-group feed dogs, and a pressure foot, so that chain-off's formed in a lock stitch sewing machine can be reliably retained.

(2) The apparatus for forming stitch chains by a two-needle type sewing machine disclosed in Japanese Patent Publication No. 58191/1982 is constructed so that, when the absence of fabrics is detected, the tension of the thread on one of the two needles is relieved to enable the tension-relieved needle thread to lie along a double chain stitch chain-off formed by the other non-tension-relieved needle thread. Accordingly, cover stitch chain-off's can be formed.

(3) The needle plate for hemstitch sewing machines disclosed in Japanese Utility Model Publication No. 25754/1986 is provided with chain-off guide grooves for guiding double chain stitch chain-off's in the fabric feeding direction, so that double chain stitch chain-off's can be formed.

(4) The thread loop forming apparatus for multi-needle loop stitch sewing machines disclosed in Japanese Patent Laid-Open No. 23887/1991 is provided with a sewing thread braking unit below a stitch forming member provided between two stitch hole slits of a stitch plate, and on the rear side of a sewing needle with respect to the sewing direction, so that the sewing thread braking unit can act as a substitute for non-existing knitted fabrics, and this enables chain-off's to be formed.

(5) In the apparatus for forming double chain stitches, and feed dogs and a needle plate therefor disclosed in Japanese Patent Laid-Open No. 237275/1993, the feed dogs provided in through holes, which are formed in a feed side portion of the needle plate, are divided in a position halfway between two needles, by which double chain stitch chain-off's are fed out, into front and rear groups with respect to the fabric feeding direction, and a stitch retaining web is formed at the portion of the needle plate which is between the two-group feed dogs, a web being also formed at the portion of the needle plate which is between a chain-off feed hole (thread passing slit) for a needle plate claw (U-shaped slit) formed thereon and the through holes in which the two-group feed dogs are provided.

This enables the chain-off stitch which has just been formed to be retained by the two-group feed dogs, two webs and pressure foot (fabric holder). Since a sensor for generating a fabric end signal is provided, a feeder driving mechanism becomes possible to increase a stitch length and reduce a feed rate on the basis of the fabric end signal. Therefore, continuous chain-off stitches can be formed.

(6) In the method of and apparatus for drawing out chain-off's by a two-needle and three-thread sewing machine, and a chain off, disclosed in Japanese Patent Laid-Open No. 300991/1993, an auxiliary blade is provided in parallel with a looper, and a free end portion of a needle plate claw (elongated plate) projects retractably from a needle hole of a needle plate. Rear chain-off feed dogs are provided on the rear side with respect to the fabric feeding direction, and guide grooves are formed so as to extend from a position on the left side of the needle hole toward the central portion of the rear feed dogs. The sewing machine is provided with sewing thread tension unit group and a chain-off forming thread tension unit group.

Owing to this arrangement, when the tension of the needle threads and looper thread is switched to low and high levels respectively at the time of completion of a fabric sewing operation, a slackened needle thread is brought close to the other needle thread and combined therewith into one string-like thread, which is guided in an auxiliary blade-supported condition toward the central portion of the rear feed dogs via the guide grooves and fed out by the rear feed dogs. Accordingly, stable chain-off's can be smoothly drawn out.

(7) The chain-off forming apparatus for cover stitch sewing machines disclosed in Japanese Patent Laid-Open No. 182079/1994 is provided with a means for detecting the presence or absence of fed fabrics, looper thread tensing means adapted to be operated in accordance with a detection result sent from the fabric detecting means, and increase the tension applied to the looper thread, a needle thread slackening means for collectively reducing the tension applied to each of the needle threads, a means for correcting a feed rate of the rear feed dogs to a higher level, and a chain-off thread holder provided across a needle plate so as to divide a hole, in which the feed dogs are exposed, into front and rear portions, and steadily holding chain-off's with a gripper.

This arrangement enables while the fabrics to be sewn are not fed, the tension of all the needle threads to be reduced to a level at which the tension is not gotten rid of and that of the looper thread to be increased at the same time, and stable chain-off's in which a plurality of slackened needle threads are tensed by the taut looper thread to be formed without causing the needle threads to be slackened.

(8) The double chain stitch sewing machine disclosed in Japanese Patent Laid-Open No. 8667/1995 is provided with a loop holder set on a needle guard and supporting needle thread loops, which are formed on needles, from the side portions thereof, a claw member extending from needle holes of a needle plate in the fabric feeding direction, projecting at one section of a front end region thereof in the fabric feeding direction to be enclosed with a stepped slit and thereby forming a projecting portion exclusive of a part of the section of the front end region thereof with the other end section thereof cut off, guide grooves formed in an upper surface of a lateral bar between the slit and feed dog holes so as to extend from the central portion of the lateral bar toward a rear side portion thereof, a means for switching an operating mode of a thread tension unit to a fabric sewing mode or a chain-off forming mode, and a thread take-up spring provided between the thread tension unit and an under-thread take-up means.

Since this arrangement enables the tension of the under-thread and a right needle thread to be switched to a high level and a low level respectively by a tension change-over means when the fabrics have finished being sewn, so that left and right needle threads are converged. Therefore, collective chain-off's can be formed, which can be held between rear feed dogs and pressure foot and drawn out via the guide grooves of the lateral bar. It is also possible to support needle thread loops laterally by the loop holder, and, moreover, an amount of movement of the needle thread hung on the looper in accordance with movement of the looper decreases owing to the claw member, so that the chain-off's can be formed and drawn out reliably.

(9) The multi-needle double chain stitch sewing machine disclosed in Japanese Patent Laid-Open No. 275546/1995 is provided with a U-shaped guide formed by making a pair of thread passing holes in a needle bar, and a thread spreader fixed to a sewing machine body and having a vertically extending cam, an operating surface of which is formed so as to bend the right needle thread, which is passed through a thread passing hole, gradually greatly when the U-shaped guide lowers in accordance with a downward movement of the needle bar. The relative positions of a thread path and a thread take-up cam are set changeable. A thread tension relieving means adapted to interrupt an operation with respect to threads of a second thread tension unit for looper thread during a sewing operation, and interrupt an operation with respect to threads of a first thread tension unit for right needle thread during the formation of chain-off's is further provided as a thread tension change-over means.

Owing to this arrangement, when the thread tension unit is switched at a terminal end of a sewing operation to form chain-off's, the flagging of the slightly slackened right needle thread is offset by the operation of the cam of the thread spreader, so that the formation of small loops and the protrusion thereof from chain-off's can be prevented, this enabling collected chain-off's to be drawn out. It is also possible to set a looper thread take-up rate of the thread take-up cam during a chain-off forming operation lower than that thereof during a sewing operation, thin collected chain-off's can be formed.

If the right needle thread and looper thread are passed through the respective thread tension units so as to relieve the tension of one of the thread tension units when the tension is switched, the occurrence of disorder of the threads can be prevented at the tension switching time.

(10) The thread control apparatus for double chain stitch sewing machines disclosed in Japanese Patent Laid-Open No. 285666/1997 is provided with a thread tension unit, which is adapted to apply tension to a looper thread, in the portion of a thread path which is between a looper and a thread take-up means for looper thread, and the thread tension unit has a means for interrupting the operation thereof only when chain-off's are formed. A needle guard is provided with a chain-off thread holder for supporting chain-off's from a position below a rear portion of the looper.

This arrangement enables the right needle thread slackened during the formation of chain-off's to be drawn out early and reliably, tight chain-off's to be formed, and the tension of the looper thread to be maintained in a suitably controlled condition, so that the chain-off's can be drawn out stably even when the sewing machine is operated at a high speed. Since the flagging of the needle threads and chain-off's in a position in the vicinity of a lower dead center of each needle can be prevented by the chain-off thread holder, the effect in preventing the breakage of the chain-off's ascribed to the double hanging of the thread on the looper can be improved.

In order to form chain-off stitches continuously in a stable condition in the inventions disclosed (1)–(10), it is necessary to detect the presence or absence of fabrics to be sewn, by a detecting means, such as a sensor, and vary the tension applied to needle threads and looper thread, by a thread tension control means in accordance with the result of the detection of the execution or non-execution of the feeding of fabrics to be sewn. Special devices, such as a chain-off thread holder, a loop holder and a thread spreader have to be provided for forming stable chain-off's, and this causes the chain-off forming structure to be complicated. Even when such special devices are provided, such chain-off's that meet only a certain narrow range of sewing conditions can be obtained, and it can hardly be said that such chain-off's meet a wide range of sewing conditions.

SUMMARY OF THE INVENTION

The present invention has been developed with a view to eliminating these difficulties encountered in the conventional techniques, and aims at providing a chain-off forming apparatus for cover stitch sewing machines, having a simple construction and capable of continuously sewing cover stitch sewing chain-off's in a stable condition.

The chain-off forming apparatus for cover stitch sewing machines according to the present invention which achieves this object is adapted to introduce double chain stitch chain-off's, which are formed below a needle plate by the intertwining of the threads on a plurality of needles and a thread on a looper in accordance with the actions of the needles and looper occurring when fabrics to be sewn are not fed, onto the portion of an upper surface of the needle plate which is behind needle points, and feed out the chain-off's continuously with the chain-off's held between rear feed dogs on the rear side of the needle points and a chain-off thread gripper, the needle plate being provided with a thread positioning spreader which is adapted to engage in a position behind the needle points while the fabrics to be sewn are not fed the connected needle threads and looper thread with each other at predetermined intervals when the needles are moved into substantially triangular spaces formed by the looper thread connected from previously formed on feeding the fabrics to be sewn double chain stitchs to the looper and needle threads hung on the looper, and which is adapted to have the looper enter the loops formed by the needle threads when the needles are moved back, feed double chain stitch chain-off's, remove the intertwined needle threads from the looper, and maintain the intertwined needle threads and looper thread in an engaged state.

According to this chain-off forming apparatus for cover stitch sewing machines, the drawing of chain-off's due to the vertical linear reciprocating movements of the needles can be prevented, and, moreover, the respective threads can be indexed to predetermined positions against the arcuate reciprocating movements of the looper. Therefore, chain-off stitches can be formed continuously in a stable condition in which the occurrence of a skip is not encountered, without being influenced by the arcuate reciprocating movements of the looper.

In the chain-off forming apparatus for cover stitch sewing machines according to the present invention, the thread positioning spreader is preferably formed of a retainer having inclined portions indexed to needle points and provided between recesses of the needle plate. Owing to this structure, the locking claw can prevent, when the looper hooks the needle thread loops on the backwardly moving (ascending) needles and advances the needle threads hung on the looper and the chain-off's connected to these needle threads from being drawn in the direction in which the looper advances, so that thread rings formed by the respective needle threads and looper thread can be indexed to the respective needle points. The inclined portions of the retainer enables the chain-off's engaged with the retainer to be released when the needles are moved back from the needle plate to cause the feed dogs to start drawing the chain-off's with the looper displaced in the direction opposite to the direction in which the fabrics are fed as it draws back the needle threads hung thereon. Accordingly, it is possible to prevent by a simple structure the chain-off's from being withdrawn, and, moreover, to form chain-off's continuously in a stable condition in which the occurrence of a skip is not encountered.

In the chain-off forming apparatus for cover stitch sewing machines according to the present invention, the direction in which the thread positioning spreader is set is preferably inclined correspondingly to a triangular shape. This enables triangular thread rings through which the needles can be passed reliably to be formed, and the needles to hook the looper thread accurately.

In the chain-off forming apparatus for cover stitch sewing machines according to the present invention, the needle plate is preferably so formed that the sewn double chain stitch chain-off's be sent out from the side of the direction in which the looper is moved forward. This enables the knitted chain-off's to be drawn out from the looper rearmost retreating point, and the chain-off's brought close to the foremost advancement point of the looper due to the advancement of the looper to be therefore drawn back.

In the chain-off forming apparatus for cover stitch sewing machines according to the present invention, the chain-off thread gripper is preferably provided with chain-off thread holder dogs for retaining the double chain stitch chain-off's between these dogs and the needle plate when double chain stitches are formed. Owing to this part, the chain-off's drawn out by the feed dogs can be held on the upper surface of the needle plate, and the drawing back of the chain-off's due to the operations of the needles and looper can be prevented.

DESCRIPTION OF THE PREFERRED EMBODIMENTS

A mode of a preferred embodiment of the chain-off forming apparatus for cover stitch sewing machines according to the present invention will now be described with reference to the drawings.

Figure 1:
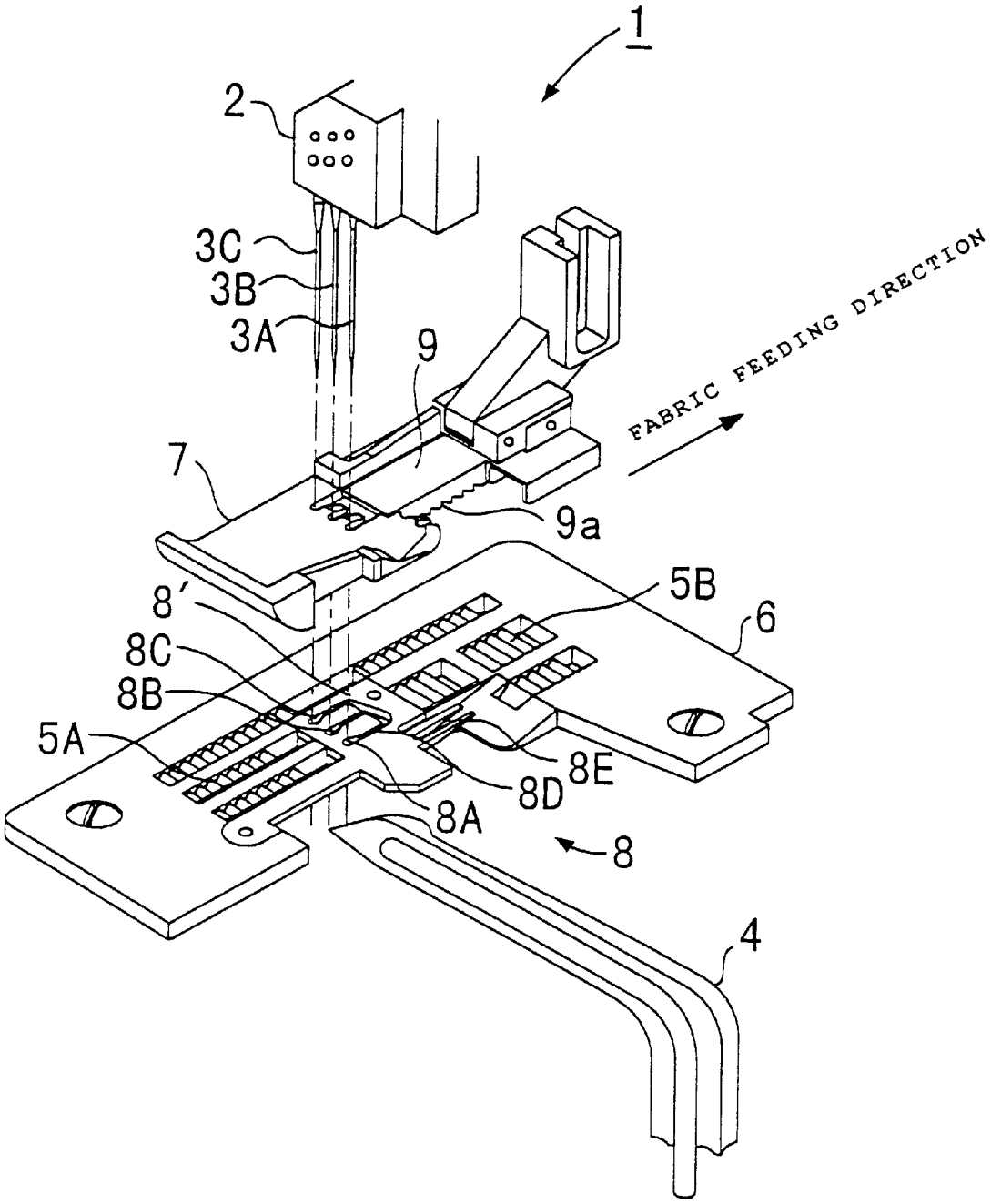
FIG. 1 is an assembling perspective diagram showing a mode of embodiment of the chain-off forming apparatus for cover stitch sewing machines according to the present invention.
Figure 2:
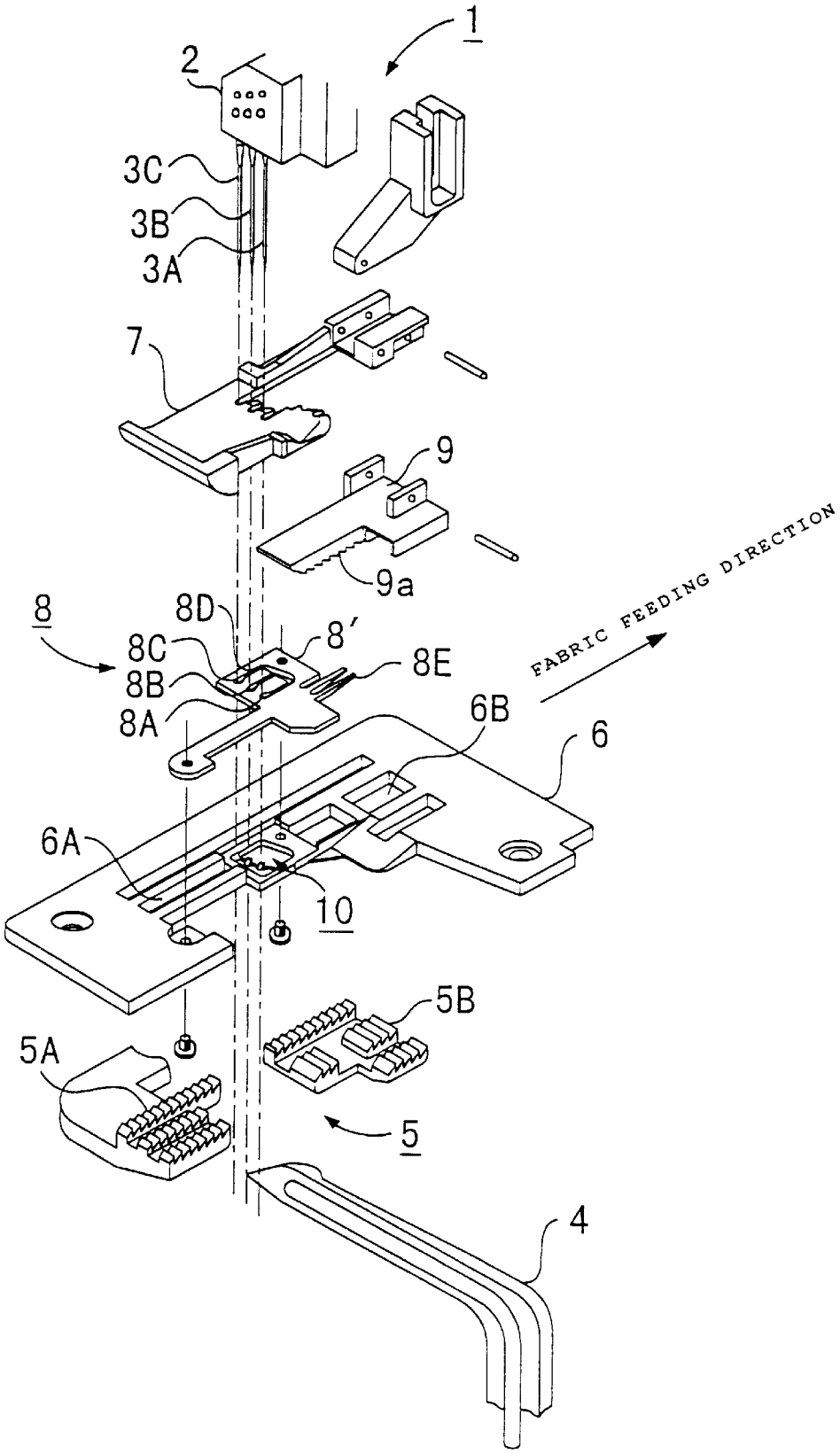
FIG. 2 is an exploded perspective view of the embodiment of FIG. 1.

As shown in FIGS. 1 and 2, the chain-off forming apparatus for cover stitch sewing machines according to the present invention is provided with three needles 3A, 3B, 3C fixed to a needle holder 2 adapted to make vertical linear reciprocating movements, one looper 4 adapted to be moved arcuately and reciprocatingly so as to cross the paths of movements of the three needles 3A, 3B, 3C, a needle plate 6 provided with the looper 4 thereunder and having needle throats for the three needles 3A, 3B, 3C and windows for feed dogs 5, and a pressure foot 7 for holding fabrics to be sewn, in cooperation with the needle plate 6. The needle holder 2 and looper 4 make reciprocating movements respectively by the rotation of a main shaft (not shown).

The three needles 3A, 3B, 3C are fixed in a slightly staggered state in the vertical direction to the needle holder 2. Therefore, it is possible to have these needles 3A, 3B, 3C intersect the looper 4 at optimum heights.

A driving mechanism (not shown) for the looper 4 is adapted to move the looper 4 below the needle plate 6 arcuately and reciprocatingly, and synchronously with the vertical linear reciprocating movements of the needles 3A, 3B, 3C, while elliptically in a horizontal direction. Namely, the driving mechanism is formed so that the arcuate reciprocating movements of the looper 4 viewed from the side of the needle plate 6 look like elliptical movements thereof.

A needle plate pallet 8 is fixed as a needle throat member for the three needles 3A, 3B, 3C to the needle plate 6, and a thread positioning spreader 10 is formed in a bottom portion of the section of the needle plate 6 to which the needle plate pallet 8 is fixed. Especially, the windows provided in the needle plate 6 for the feed dogs 5 have a plurality of front feed windows 6A and a plurality of rear feed windows 6B for exposing therein front feed dogs 5A and rear feed dogs 5B which are provided on the front and rear sides of the needle plate pallet 8. The front and rear feed dogs 5A, 5B make elliptical movements in a vertical plane in accordance with the rotation of the main shaft and synchronously with the vertical linear reciprocating movements of the needles 3A, 3B, 3C, and are exposed in the front and rear feed windows 6A, 6B respectively to intermittently feed fabrics to be sewn, in the fabric feeding direction.

Therefore, a cover stitch sewing operation can be carried out by intertwining a looper thread 40 and three needle threads 30A, 30B, 30C (refer to FIG. 5) with the fabrics to be sewn, which are placed on the needle plate 6, by the looper 4 and three needles 3A, 3B, 3C while intermittently feeding the fabrics in the fabric feeding direction by the front and rear feed dogs 5A, 5B and pressure foot 7. When the fabrics to be sewn are not fed onto the needle plate 6, double chain stitch chain-off's are knitted under the needle plate 6 by intertwining the looper thread 40 and three needle threads 30A, 30B, 30C.

Figure 3:
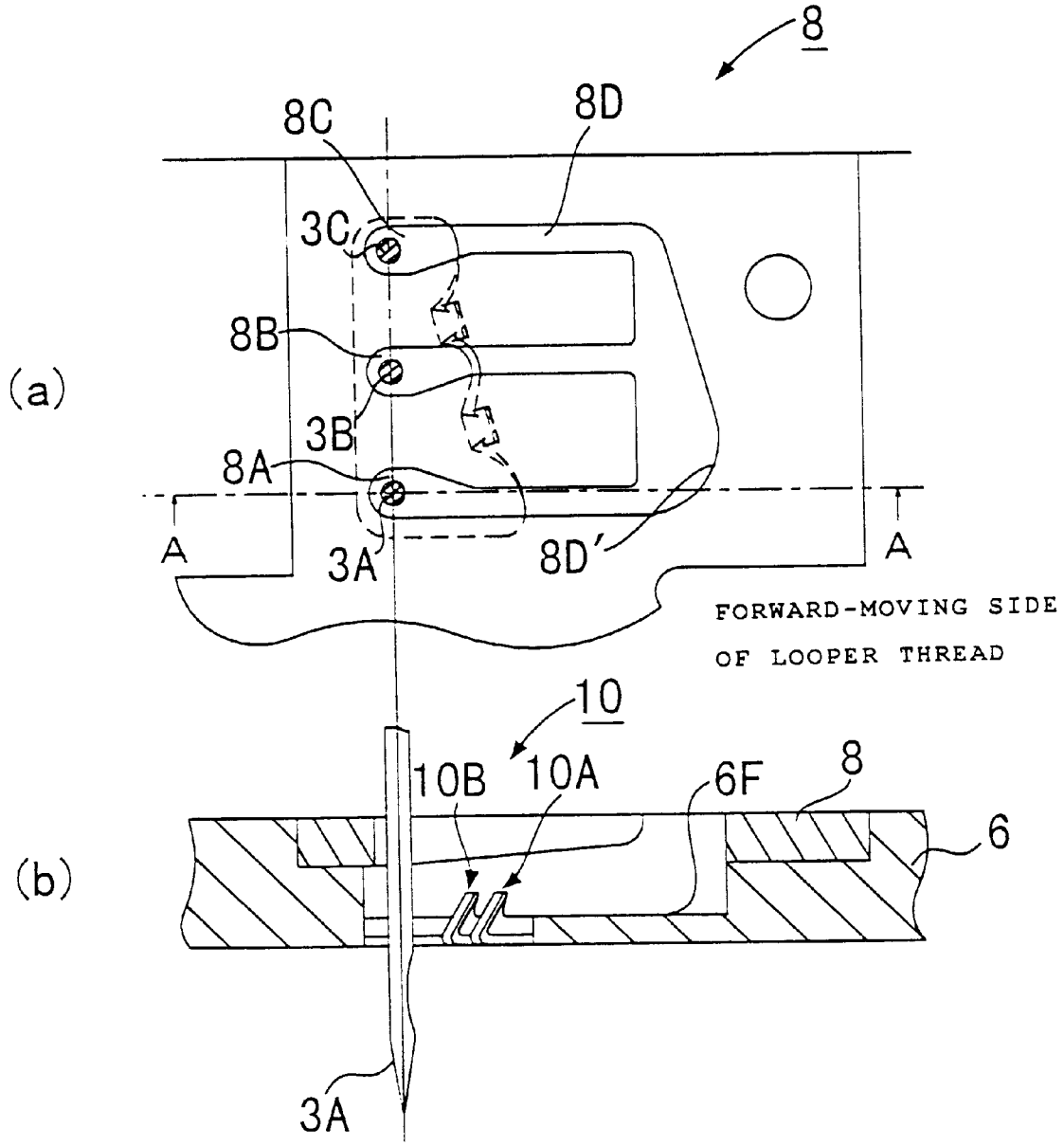
FIG. 3 is a detail drawing showing a thread positioning spreader constituting the chain-off forming apparatus for cover stitch sewing machines according to the present invention, wherein FIG. 3(*a*) is a top view, and FIG. 3(*b*) a sectional view taken along the line A—A in FIG. 3(*a*)

The needle plate pallet 8 fixed to the needle plate 6 has a needle plate pallet portion 8' provided with needle throats 8A, 8B, 8C for the three needles 3A, 3B, 3C; a gate type slit 8D formed continuously from the needle throats 8A, 8B, 8C so that the chains-off knitted by the needles 3A, 3B, 3C and the looper 4 below the needle plate 6; and a hemstitching claw 8E. The gate type slit 8D formed continuously from the needle throats 8A, 8B, 8C is formed as shown in FIG. 3, in such a manner that the sewn double chain stitch chain-off's are sent out from the side at which the looper starts advancing. To be exact, a chain-off extracting portion 8D' of the gate type slit 8D is opened incliningly so that it is widened gradually toward the side at which the looper 4 starts advancing and in the fabric feeding direction.

The portion of the needle plate 6 which is positioned under the needle plate pallet portion 8' is provided with three connected arcuate recesses 6C, 6D, 6E as needle throats for indexing the three needle threads 30A, 30B, 30C and looper thread 40 in the needle points. The needle plate 6 is provided with a recess 6F so that, when the needle plate pallet 8 is fixed thereon, a hollow space is formed in the portion of the needle plate which corresponds to the gate type slit 8D of the needle plate pallet portion 8'.

Figure 7:
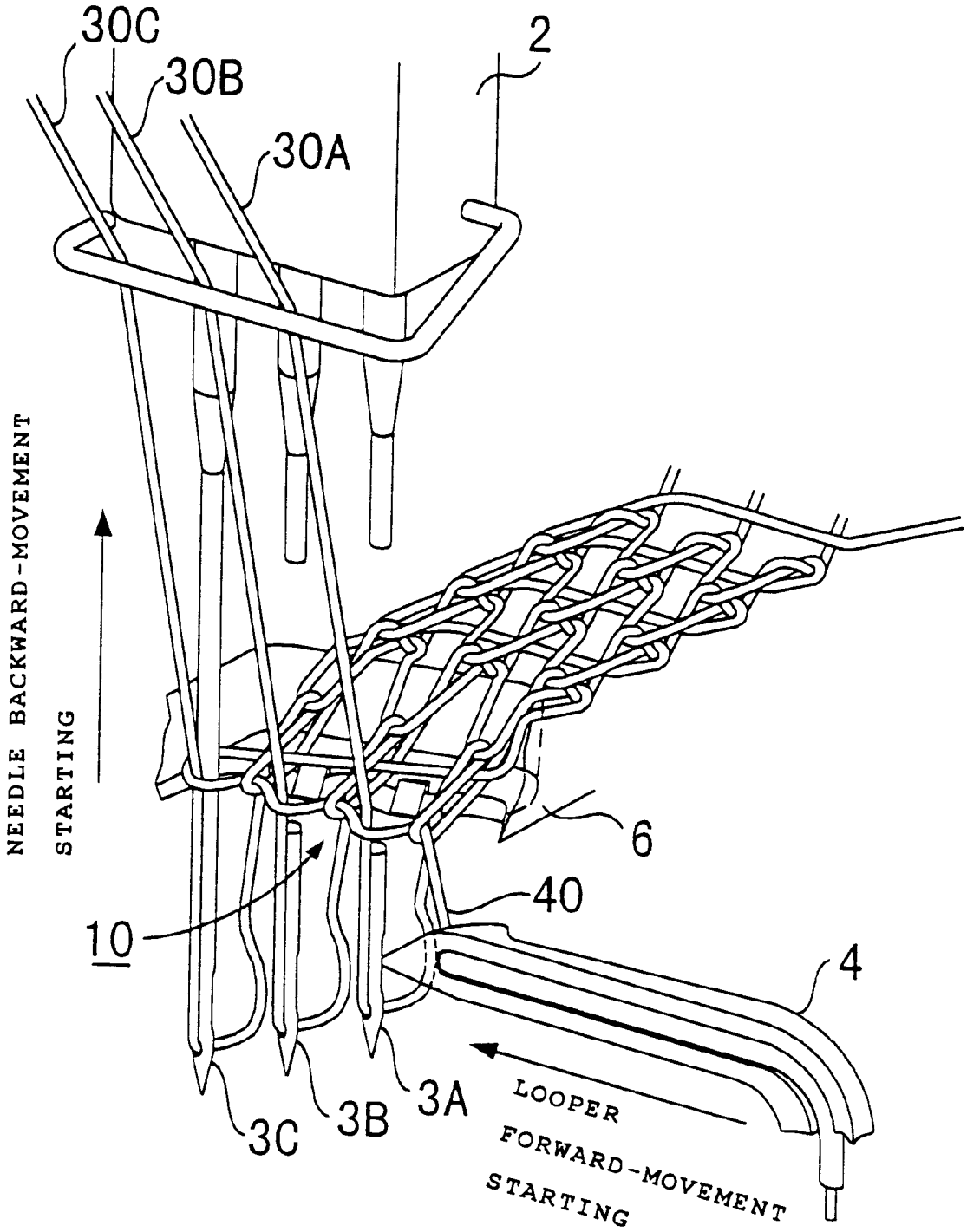
FIG. 7 is a second drawing showing a chain-off stitch sewing operation of the chain-off forming apparatus for cover stitch sewing machines according to the present invention.
Figure 8:
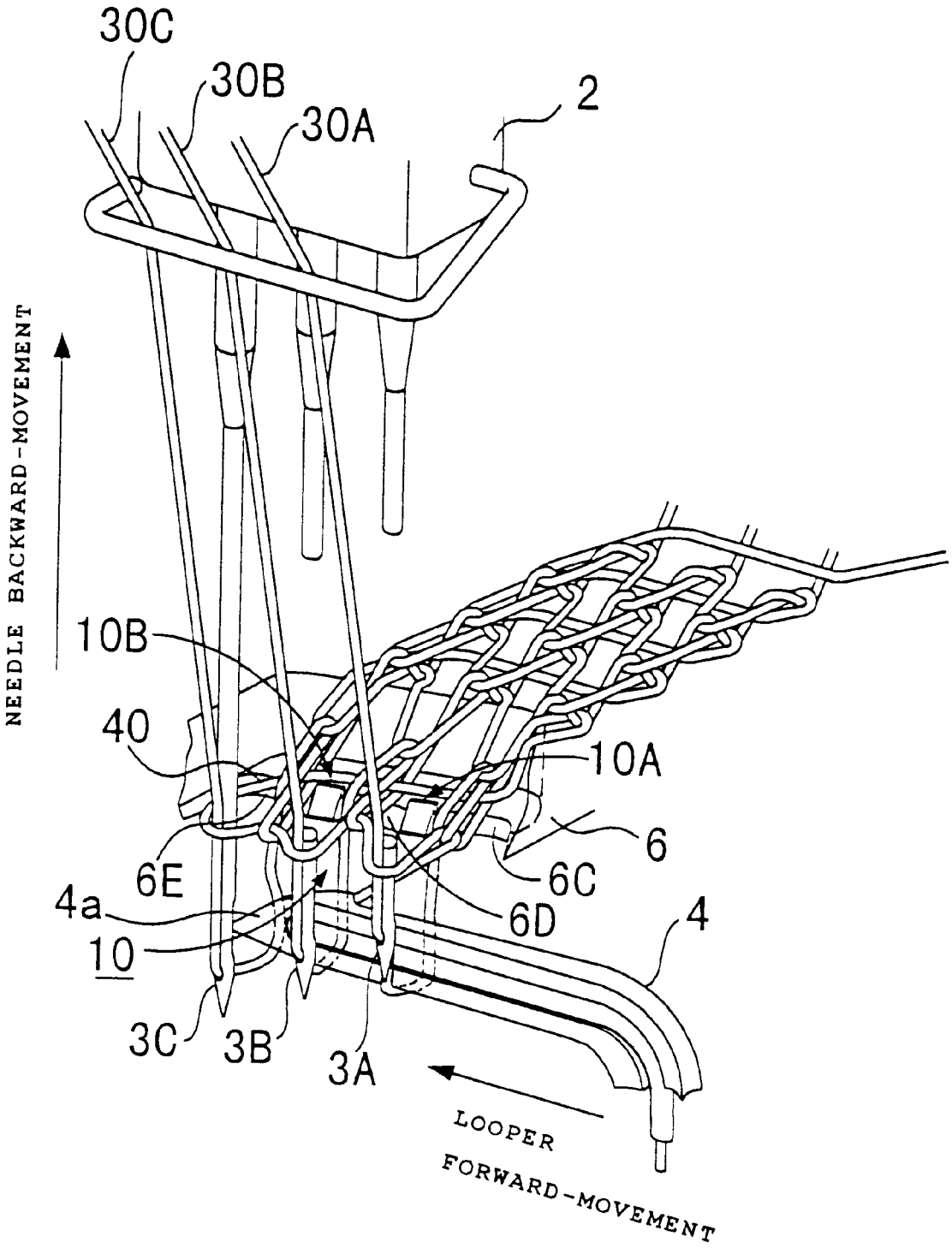
FIG. 8 is a third drawing showing a chain-off stitch sewing operation of the chain-off forming apparatus for cover stitch sewing machines according to the present invention.
Figure 10:
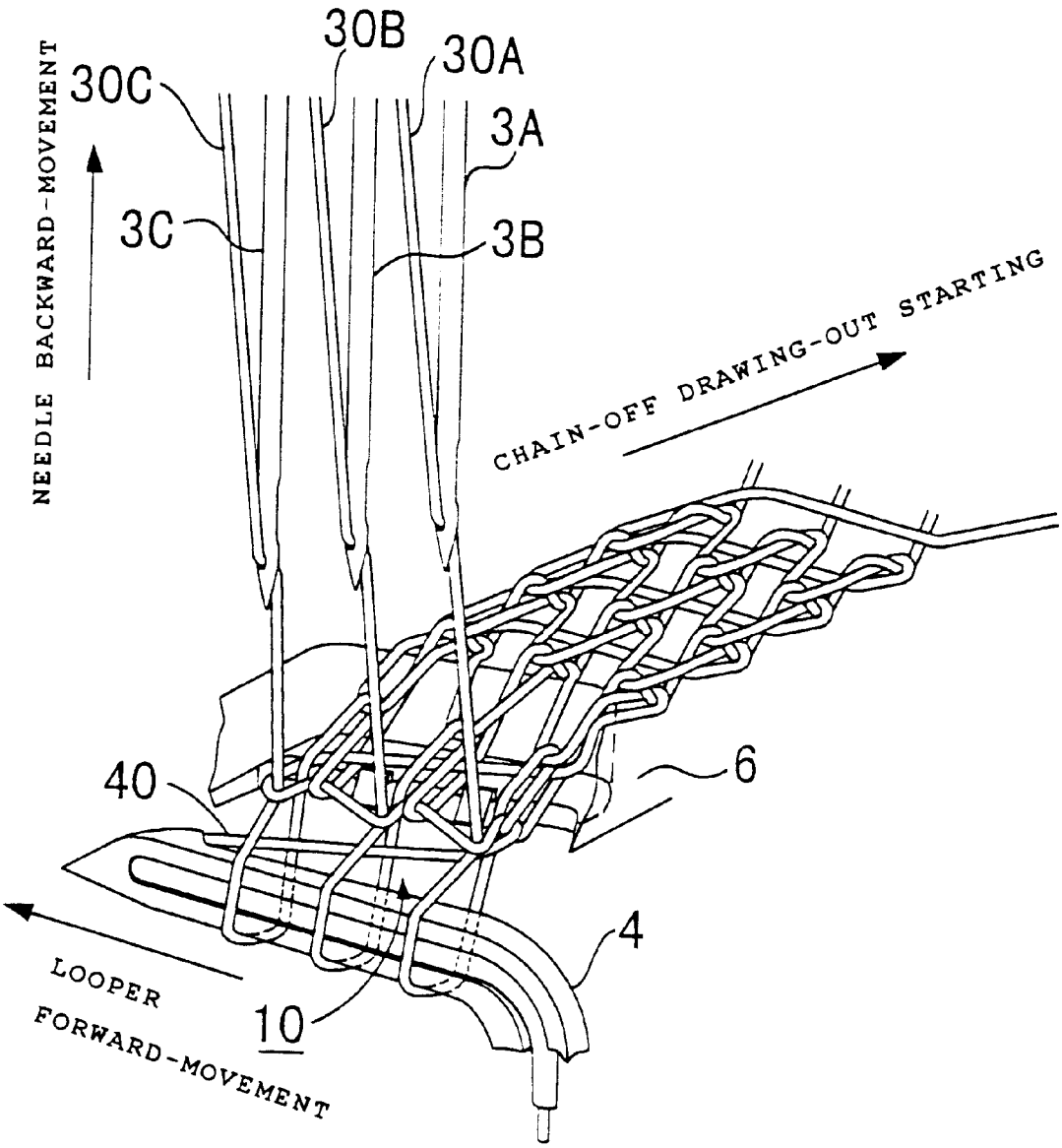
FIG. 10 is a fourth drawing showing a chain-off stitch sewing operation of the chain-off forming apparatus for cover stitch sewing machines according to the present invention.

The thread positioning spreader 10 positioned under the needle plate pallet portion 8' is formed so that the thread positioning spreader can engage in a position (on the side of the rear feed dogs 5B) behind needle points while the fabrics to be sewn is not fed the three connected needle threads 30A, 30B, 30C and looper thread 40 with each other at predetermined intervals (refer to FIGS. 13, 15 and 16) when the three needles 3A, 3B, 3C enter the substantially triangular spaces (the looper thread 40 forming these triangles include the thread passed through the looper 4, and the same applies to the triangles which will hereinafter be referred to) formed between the looper thread 40 connected from the double chain stitches, which were formed previously while the fabrics to be sewn were fed to and the looper 4 and each of the three needle threads 30A, 30B, 30C hung on the looper 4, and so that the looper 4 enters, when the three needles 3A, 3B, 3C are moved back, the loops formed by the three needle threads 30A, 30B, 30C and enables the three needle threads 30A, 30B, 30C and looper thread 40 intertwined with each other when the double chain stitch chain-off's are fed to be maintained in an engaged state (refer to FIGS. 7, 8 and 10).

Figure 4:
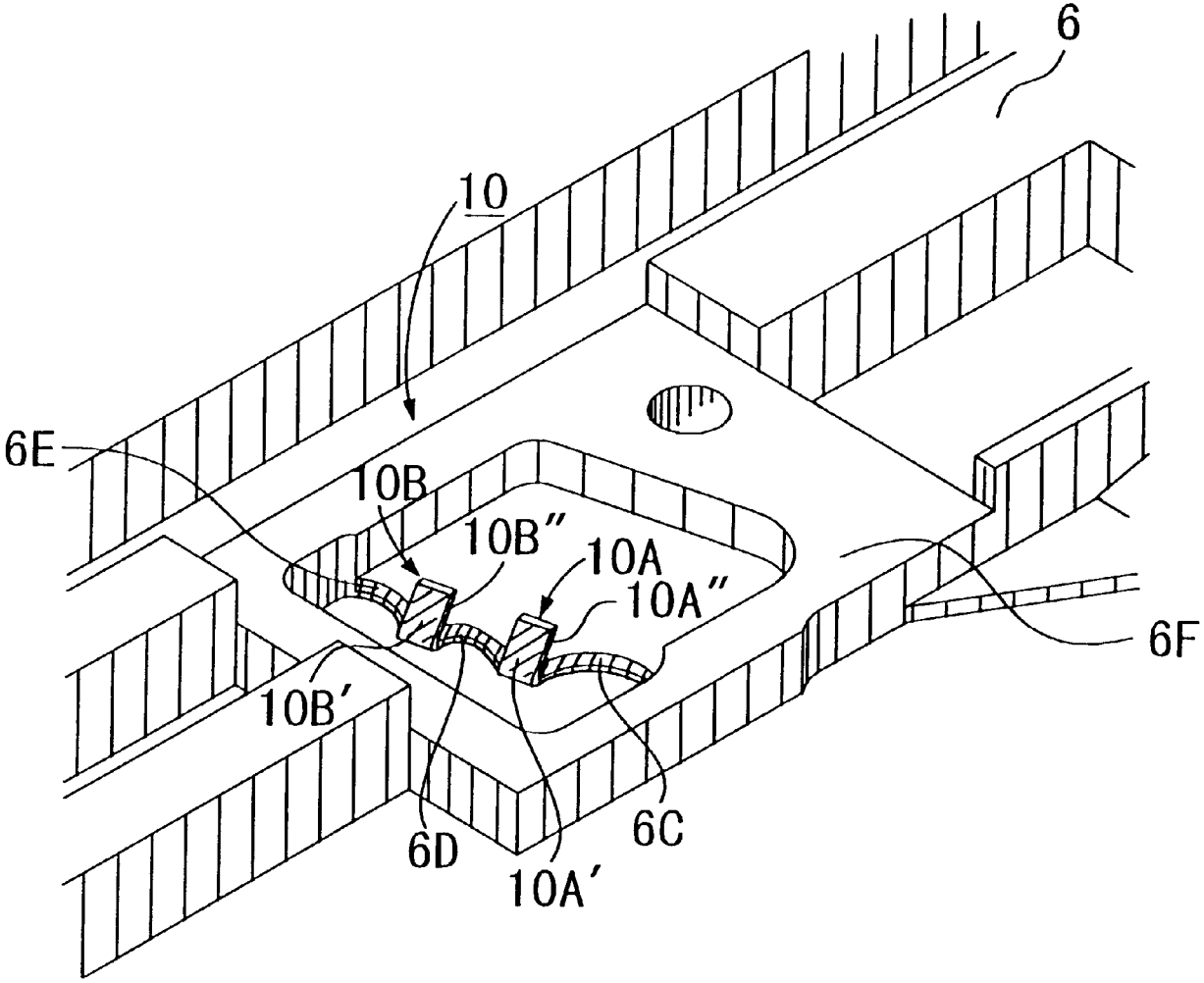
FIG. 4 is a perspective view showing the thread positioning spreader.
Figure 5:
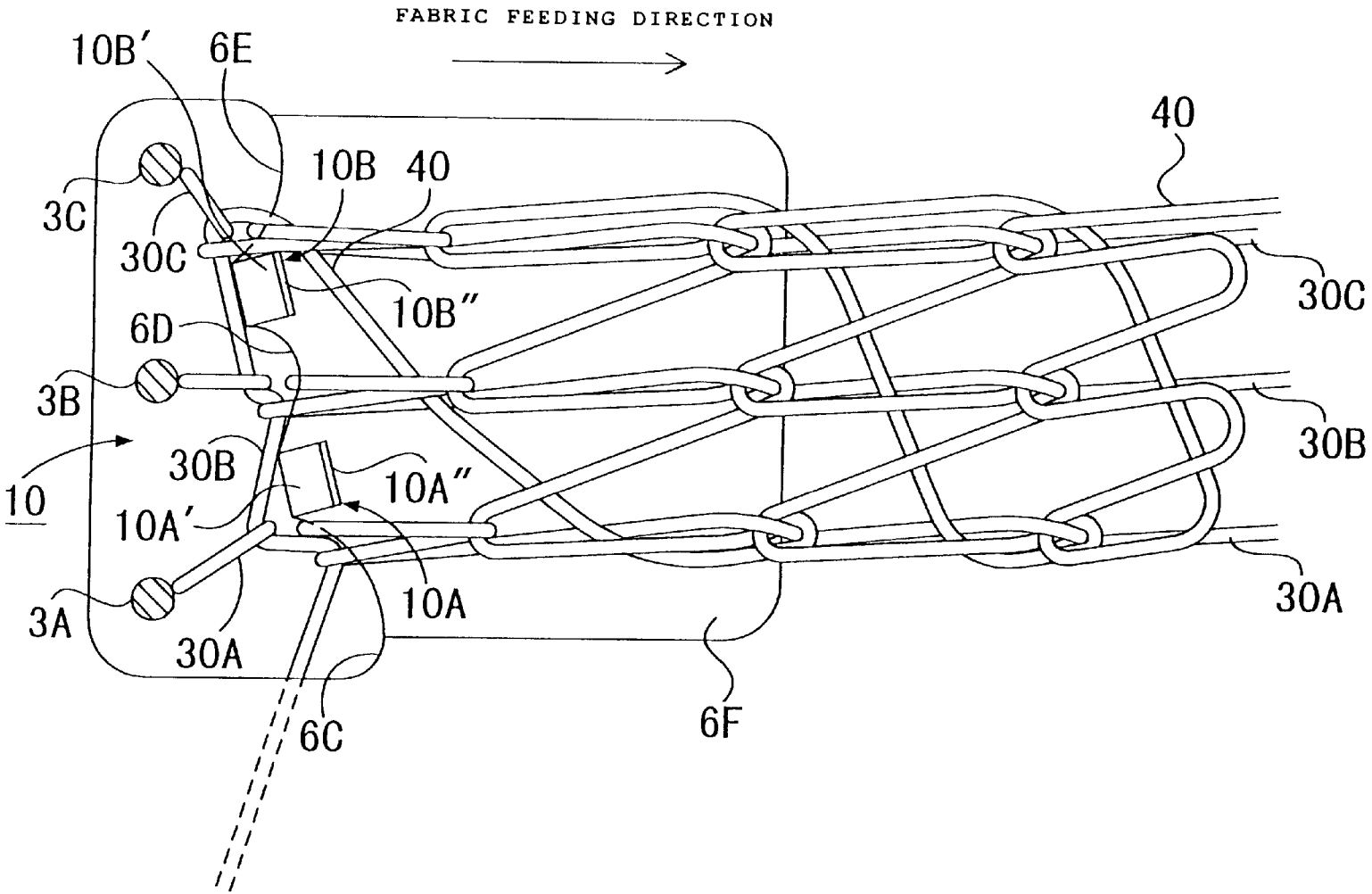
FIG. 5 is a drawing showing the relation among the thread positioning spreader, needles, needle threads and a looper thread.

As shown, for example, in FIGS. 4 and 5, the thread positioning spreader 10 is provided with two retainers 10A, 10B indexed to needle points and formed between the recesses 6C, 6D, 6E of the needle plate 6. The two retainers 10A, 10B have inclined portions 10A', 10B' extending upward from the needle points in the fabric feeding direction. The inclined portions 10A', 10B' are provided with chain-off hooks 10A", 10B", on which double chain stitch chain-off's are to be hung, in such a manner that the chain hooks 10A", 10B" project from an upper surface of the recess 6F of the needle plate 6.

The direction in which the thread positioning spreader 10 thus formed is set is diagonal correspondingly to the triangular spaces formed by the looper thread 40 and three needle threads 30A, 30B, 30C. Namely, the recesses 6C, 6D, 6E of the needle plate 6 with the two retainers 10A, 10B are formed so as to incline along the looper thread 40 connected between the double chain stitches and looper.

As shown in FIGS. 1 and 2, the pressure foot 7 has a chain-off thread gripper 9 secured thereto by a fixing pin, and the chain-off thread gripper 9 is provided with chain-off pressing teeth 9*a* for holding double chain stitch chain-off's between themselves and needle plate 6 during the formation of double chain stitches.

Figure 6:
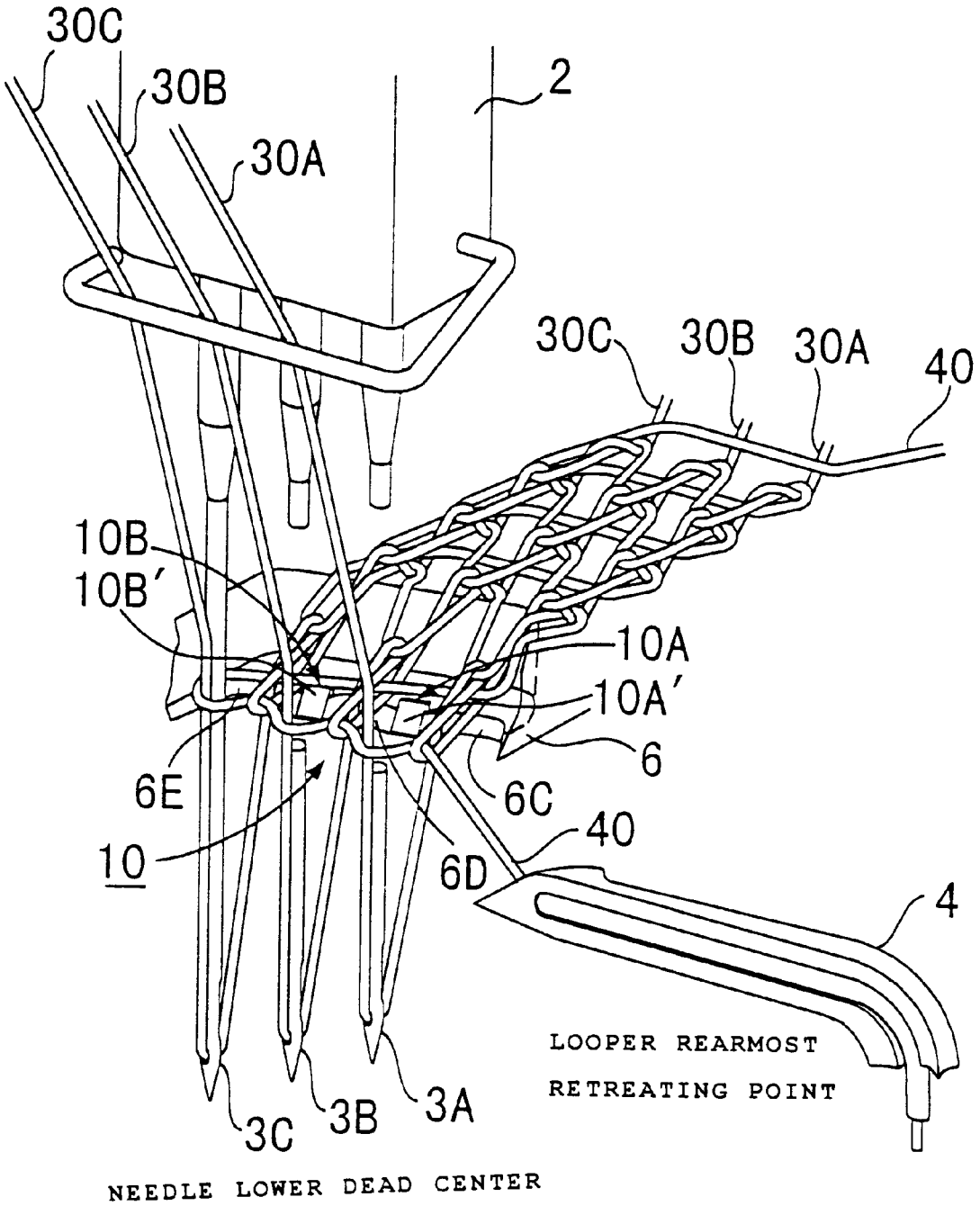
FIG. 6 is a first drawing showing a chain-off stitch sewing operation of the chain-off forming apparatus for cover stitch sewing machines according to the present invention.

A chain-off sewing operation of the chain-off forming apparatus 1 thus formed for cover stitch sewing machines will now be described. The chain-off sewing operation will start being described with respect to the condition in which double chain stitch chain-off's are sewn to a certain extent with the three needles 3A, 3B, 3C and looper 4 positioned in lower dead centers and a rearmost retreating point respectively as shown in FIGS. 5 and 6.

Figure 9:
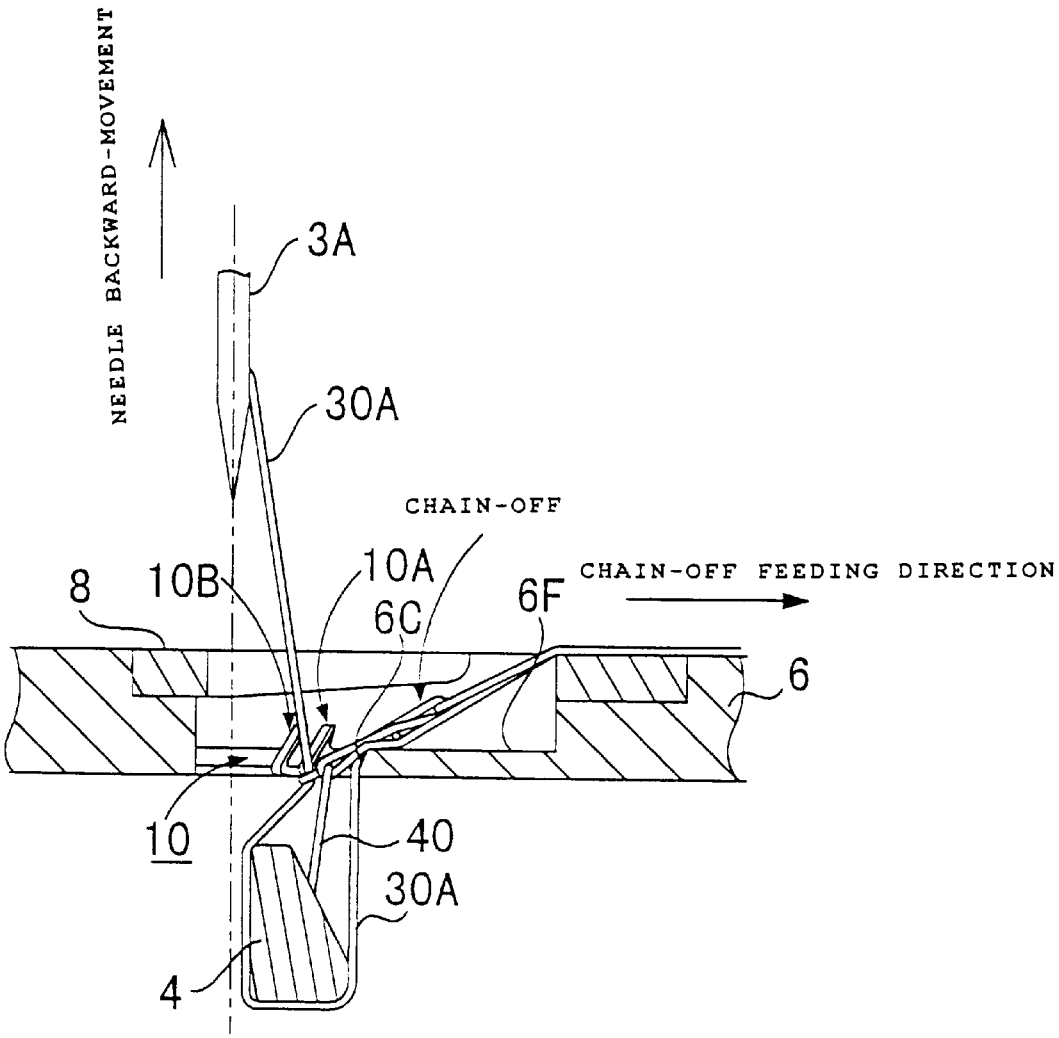
FIG. 9 is a sectional view corresponding to FIG. 8 showing a chain-off stitch sewing operation of the chain-off forming apparatus for cover stitch sewing machines according to the present invention.

When the three needles 3A, 3B, 3C in the above-mentioned condition start being moved back (moved up), the needle threads 30A, 30B, 30C passed therethrough form loops behind the needle points without being moved up with the needles 3A, 3B, 3C since these needle threads 30A, 30B, 30C are held as shown in FIG. 7, by the looper thread 40 intertwined with the needles 3A, 3B, 3C. Since the looper 4 advances in a region behind the needle points as it crosses the needles 3A, 3B, 3C in accordance with the upward movements thereof, a tip 4*a* of the looper 4 hooks the needle thread loops from the nearest loop in order as shown in FIGS. 8 and 9 and hang the needle threads 30A, 30B, 30C on the looper 4. During this time, the needle threads 30A, 30B, 30C hung on the looper 4 with the needle threads connected to double chain stitch chain-off's are drawn by the looper 4 in the direction of advancement thereof but the needle threads 30A, 30B, 30C are indexed to the recesses 6C, 6D, 6E since they can be engaged with the retainers 10A, 10B provided between the recesses 6C, 6D, 6E, which correspond to the needle threads 3A, 3B, 3C, of the needle plate 6.

When the needles 3A, 3B, 3C continues to be moved up, as shown in FIG. 10, the looper thread 40 intertwined therewith comes off from the needles 3A, 3B, 3C and is tightened by the forwardly moving looper 4. The needle threads 30A, 30B, 30C are also tightened with the needle threads hung on the looper 4 by a needle thread take-up (not shown).

Figure 11:
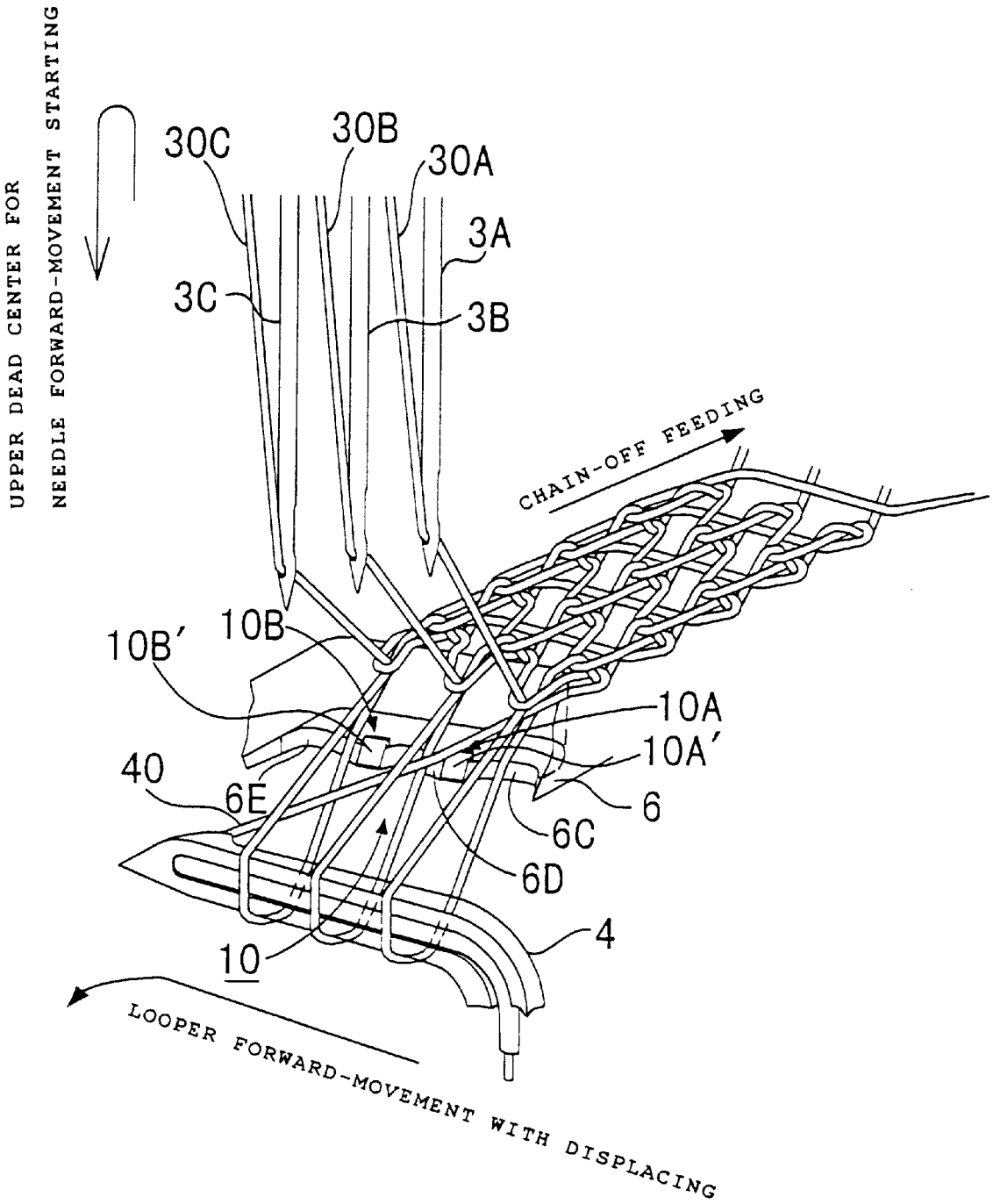
FIG. 11 is a sectional view corresponding to FIG. 10 showing a chain-off stitch sewing operation of the chain-off forming apparatus for cover stitch sewing machines according to the present invention.
Figure 12:
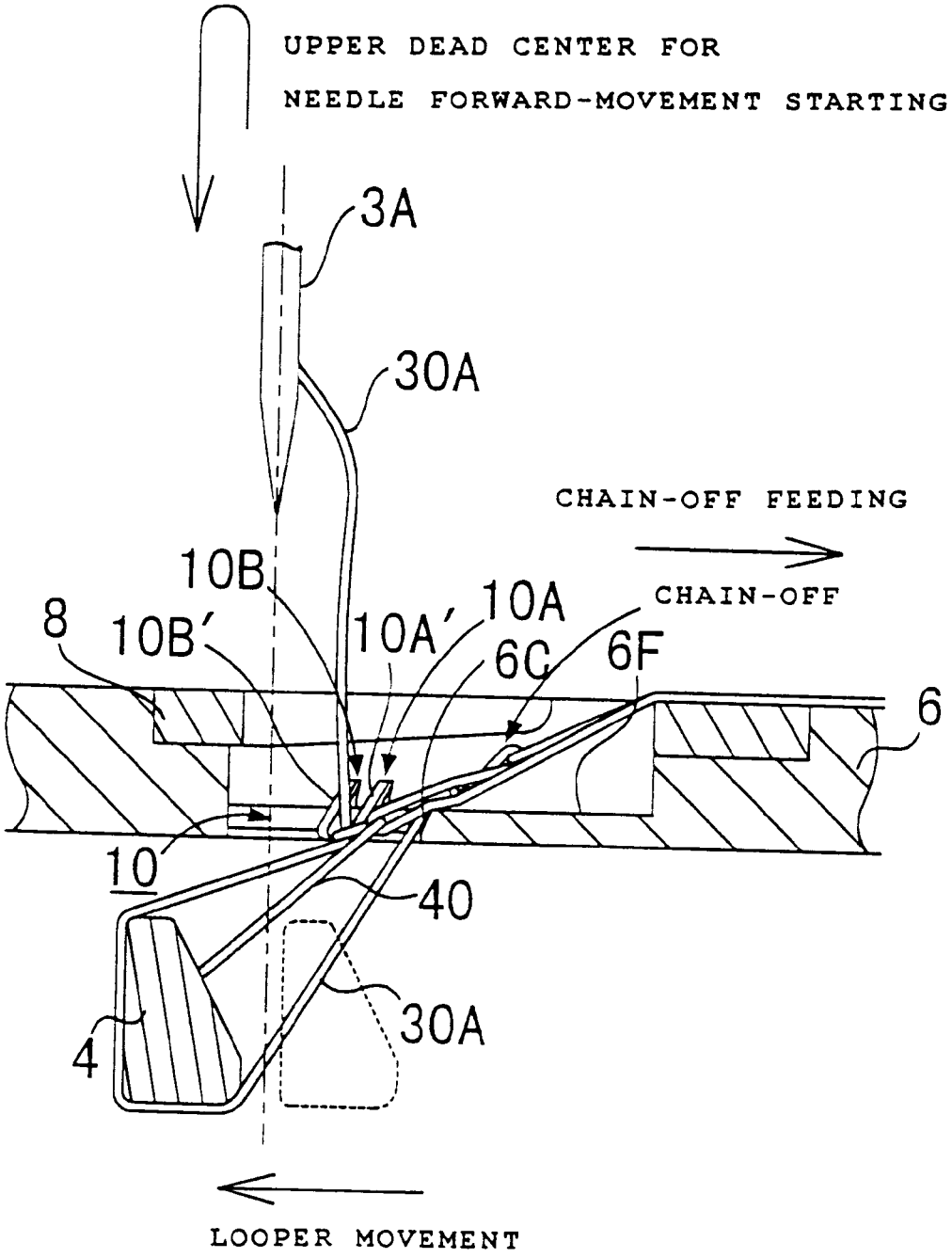
FIG. 12 is a fifth drawing showing a chain-off stitch sewing operation of the chain-off forming apparatus for cover stitch sewing machines according to the present invention.

When the needles 3A, 3B, 3C are further moved back from the needle plate 6, the rear feed dogs 5B project from the feed dog window 6B of the needle plate 6, and start drawing out chain-off's while holding the chain-off's in cooperation with the chain-off thread gripper 9 of the pressure foot 7, and the looper 4 starts being displaced in the direction opposite to the fabric feeding direction as shown in FIGS. 11 and 12. Accordingly, the needle threads 30A, 30B, 30C hung on the looper 4 are tensed in the lifting direction, and the chain-off's engaged with the retainers 10A, 10B of the thread positioning spreader 10 are raised. Consequently, the chain-off's run over the inclined portions 10A', 10B' to be released from the retainers 10A, 10B, and drawn up from the underside of the needle plate 6 along the inclined portions 10A', 10B' of the retainers 10A, 10B by the rear feed dogs 5B.

The lifted chain-off's can be drawn out from the side of the looper rearmost retreating point 4 since the chain-off extracting portion 8D' of the gate type slit 8D of the needle plate pallet 8 is opened incliningly so that it is widened gradually toward the side at which the looper 4 starts advancing and in the fabric feeding direction. Therefore, the chain-off's brought close to the foremost advancement point of the looper 4 by the forward movement of the looper 4 can be drawn back.

When the looper 4 thereafter moves forward and is displaced in the direction opposite to the fabric feeding direction to reach the foremost advancement point, it then starts moving back. At this point in time, the needles 3A, 3B, 3C start moving forward (down). The feeding of chain-off's is stopped at this time.

When the looper 4 starts moving back, the hung needle threads 30A, 30B, 30C drawn back by the looper 4 are engaged with the retainers 10A, 10B of the thread positioning spreader 10, and indexed to the needle points.

Figure 13:
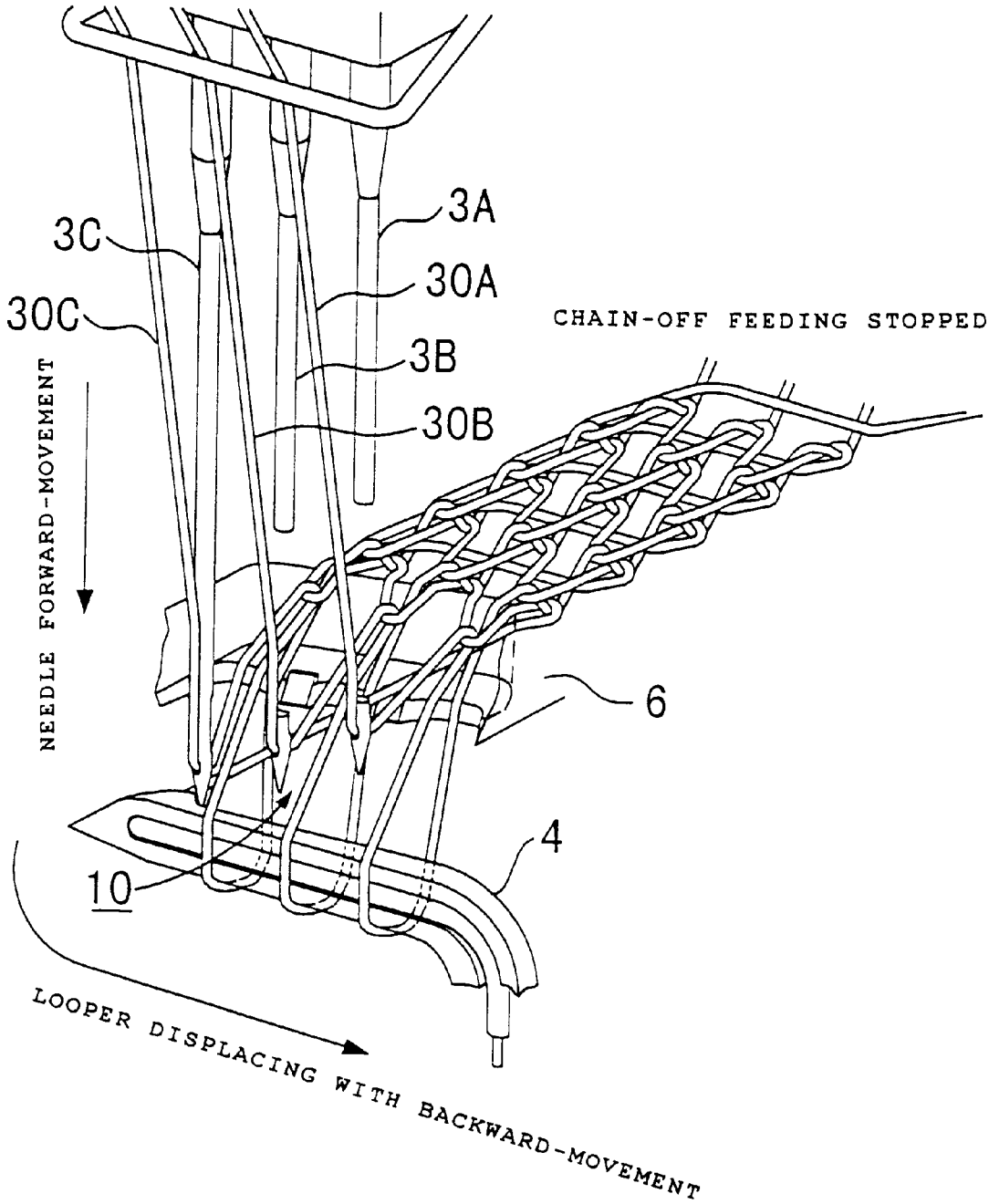
FIG. 13 is a sixth drawing showing a chain-off stitch sewing operation of the chain-off forming apparatus for cover stitch sewing machines according to the present invention.
Figure 14:
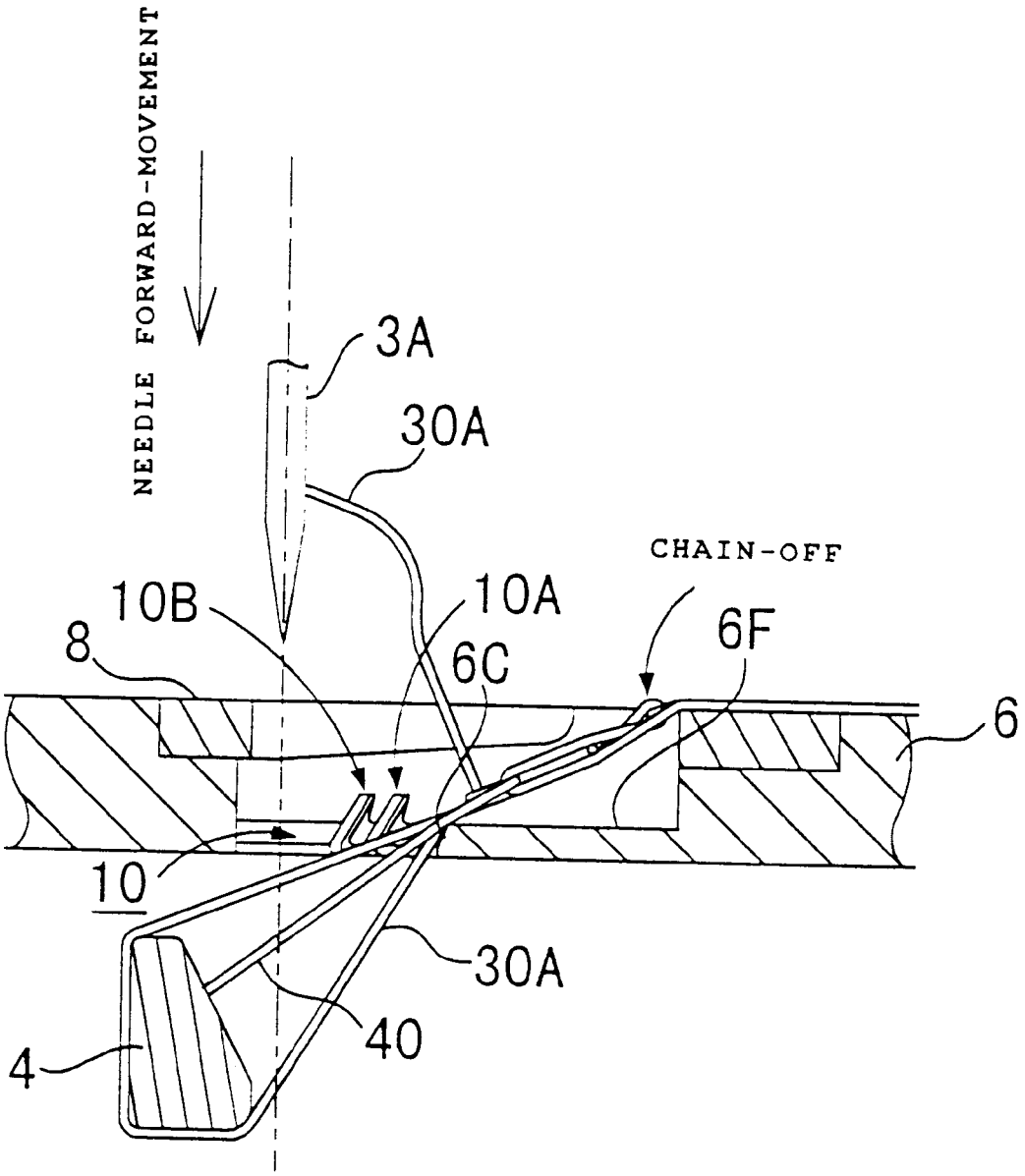
FIG. 14 is a sectional view corresponding to FIG. 13 showing a chain-off stitch sewing operation of the chain-off forming apparatus for cover stitch sewing machines according to the present invention.

When the needles 3A, 3B, 3C move forward, the looper 4 is positioned ahead of the needle points (on the side of the front feed dogs 5A) as shown in FIGS. 13 and 14, so that the looper 4 passes through the triangular thread rings formed by the looper thread 40 and needle threads 30A, 30B, 30C hung on the looper 4, and hooks the looper thread 40. Since the direction in which the thread positioning spreader 10 is set is diagonal with respect to the triangular thread rings, the needle threads 30A, 30B, 30C can be indexed to the recesses 6C, 6D, 6E of the needle plate 6, and, therefore, triangular thread rings through which the needles 3A, 3B, 3C can be passed reliably can be formed. This enables the needles 3A, 3B, 3C to hook the looper thread 40 accurately.

Figure 15:
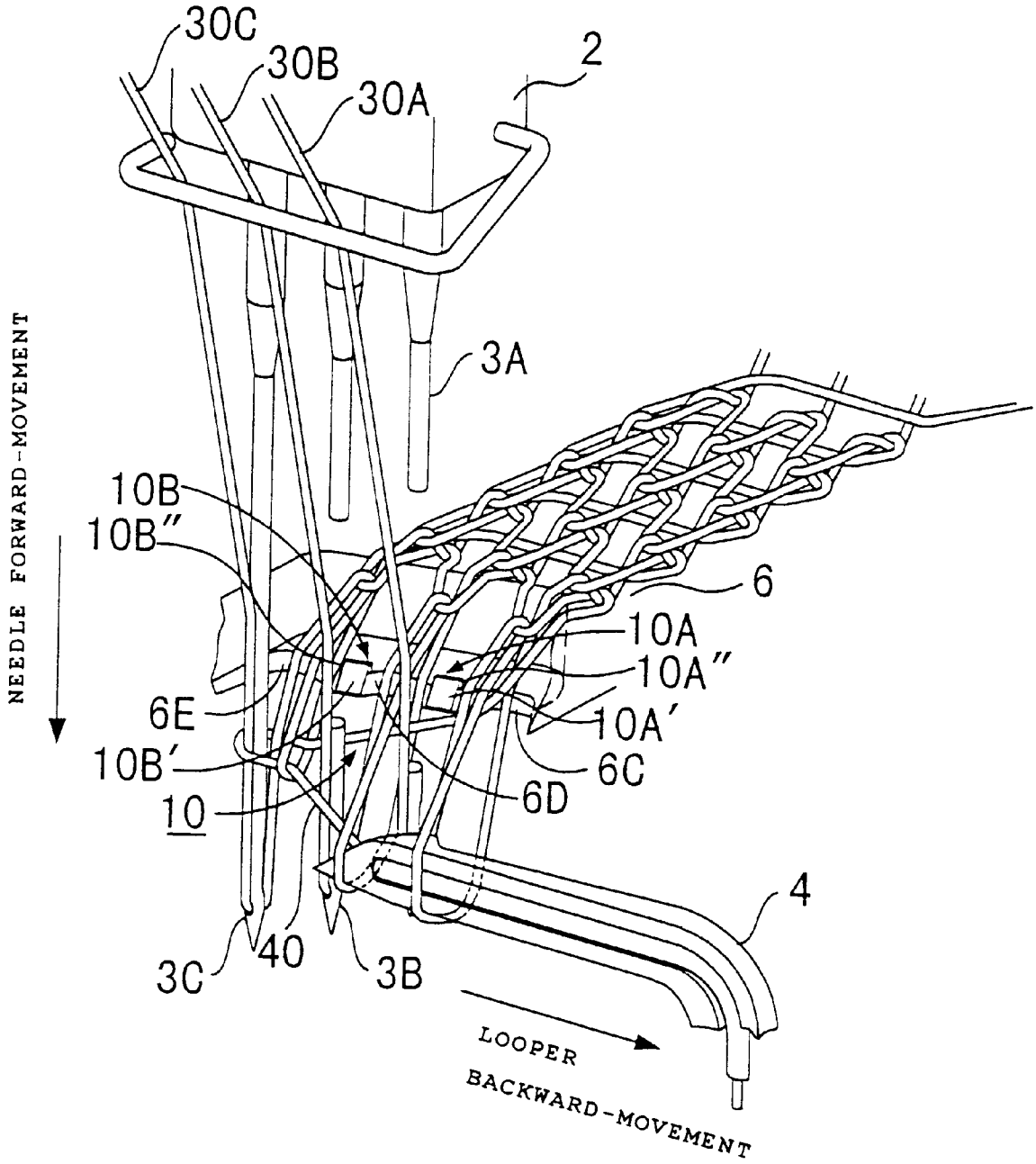
FIG. 15 is a seventh drawing showing a chain-off stitch sewing operation of the chain-off forming apparatus for cover stitch sewing machines according to the present invention.

When the needles 3A, 3B, 3C move forward as it hooks the looper thread 40 as shown in FIG. 15, the chain-off's connected to the needle threads 30A, 30B, 30C are caught by the chain-off hooks 10A", 10B" provided on the inclined portions 10A', 10B' of the retainers 10A, 10B of the thread positioning spreader 10 even when the chain-off's are drawn to positions under the needle plate 6. This can prevent the chain-off's from being drawn back to positions below the needle plate 6.

Figure 16:
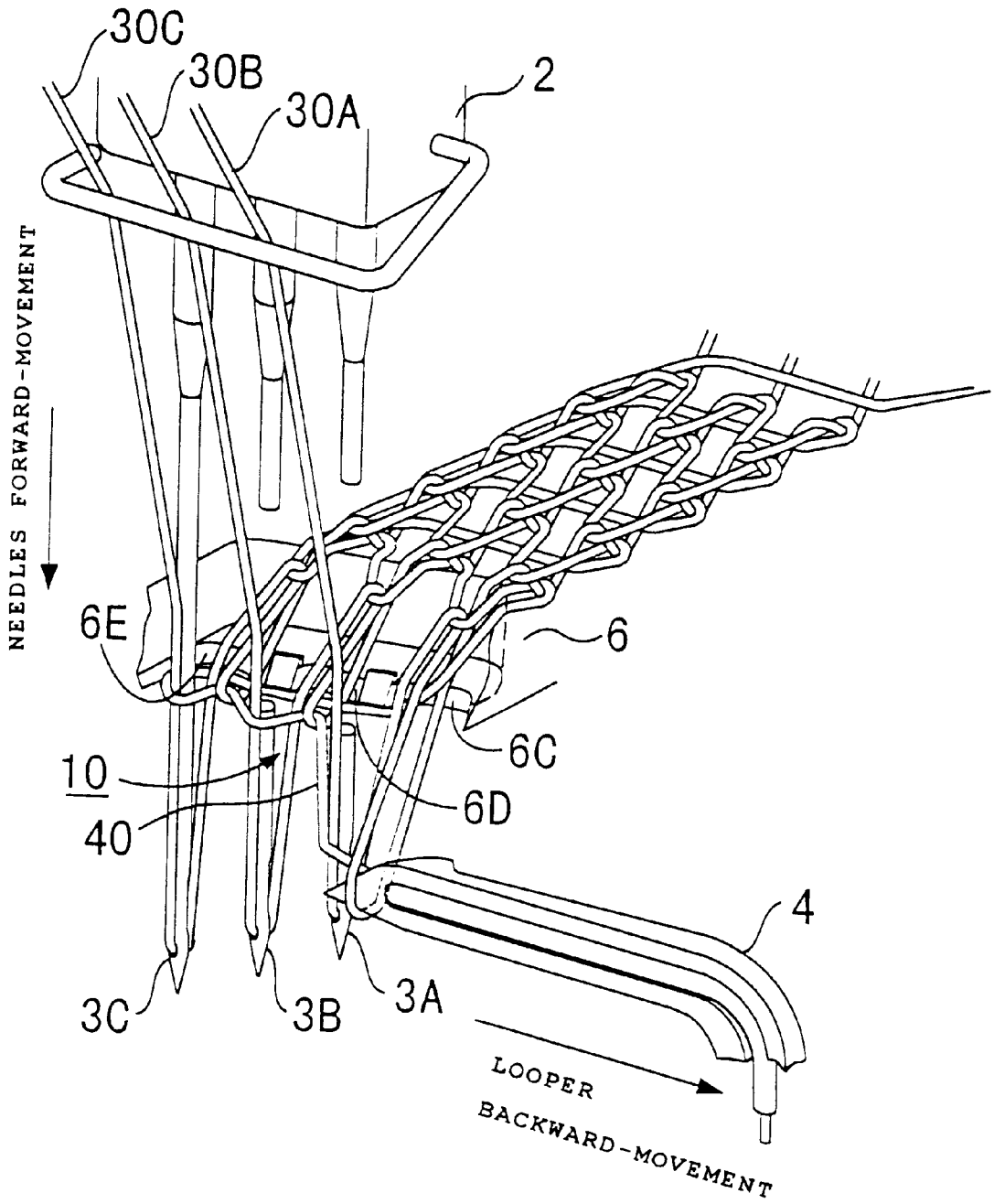
FIG. 16 is an eighth drawing showing a chain-off stitch sewing operation of the chain-off forming apparatus for cover stitch sewing machines according to the present invention.

When the needles 3A, 3B, 3C have finished hooking the looper thread 40 with the needle threads 30A, 30B, 30C which are hung on the looper 4 disengaged therefrom due to the retreat of the looper 4 as shown in FIG. 16, the needle thread take-up (not shown) lifts the needle threads 30A, 30B, 30C. When the looper 4 from which the needle threads 30A, 30B, 30C have been disengaged is further displaced in the fabric feeding direction to reach the rearmost retreating point, the needle threads 30A, 30B, 30C tensed due to the lifting operation of the needle thread take-up are indexed in a chain-off-connected state to the recesses 6C, 6D, 6E of the needle plate 6 as shown in FIG. 6.

When the above-described chain-off sewing operation is carried out repeatedly, chain-off stitches can be formed continuously in a stable condition.

Figure 17:
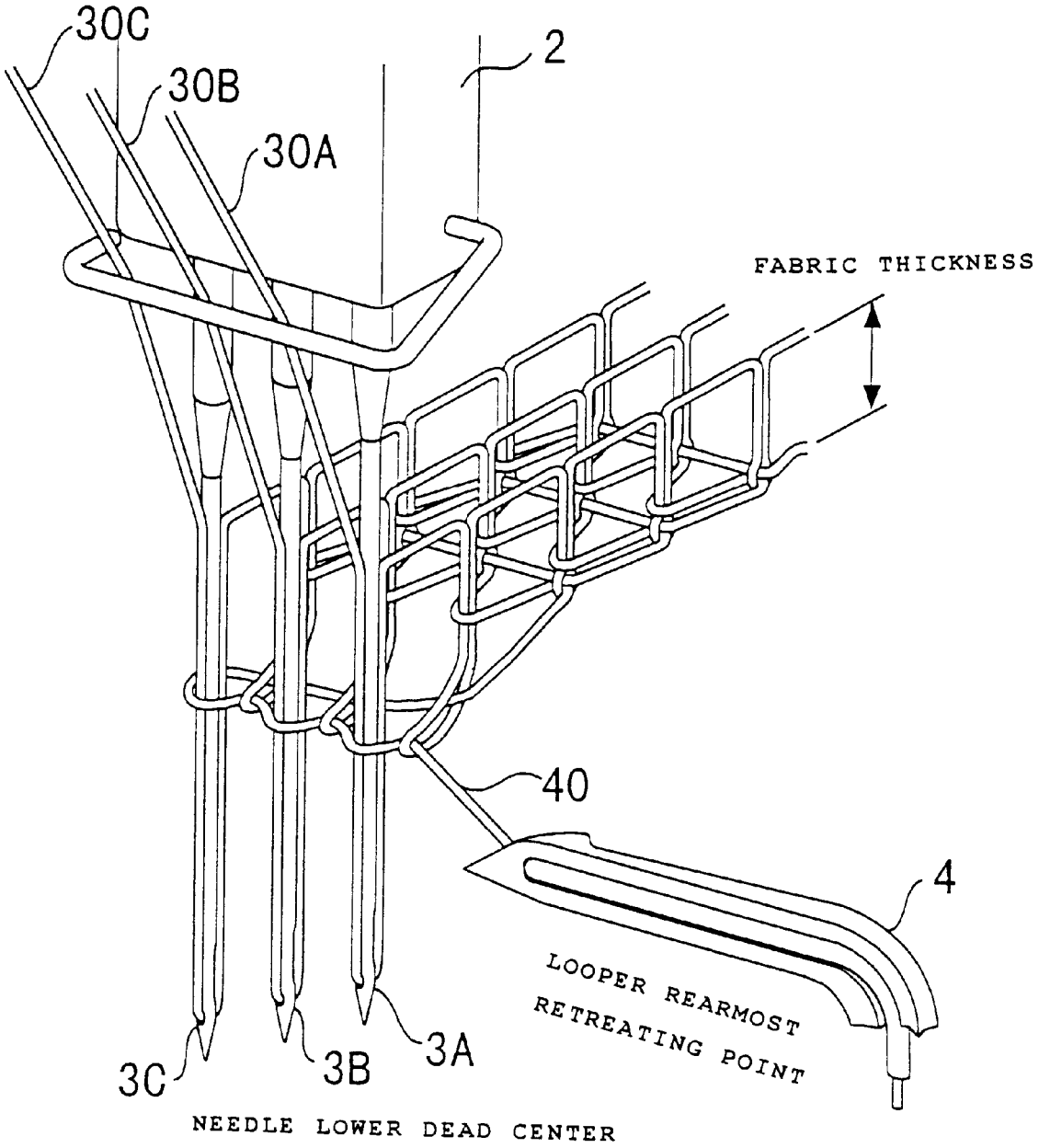
FIG. 17 is a first drawing showing a sewing operation of a cover stitch sewing machine according to the present invention.

The sewing operation, which is carried out with fabrics to be sewn fed, of a cover stitch sewing machine to which the chain-off forming apparatus according to the present invention is applied will now be described. In FIGS. 17–23 used for describing the sewing operation, illustrations of fabrics to be sewn will be omitted for convenience' sake. As shown in FIG. 17, the sewing operation will start being described from the condition in which the fabrics to be sewn which have been fed are sewn to a certain extent with the three needles 3A, 3B, 3C and looper 4 positioned in lower dead centers and rearmost retreating point respectively.

Figure 18:
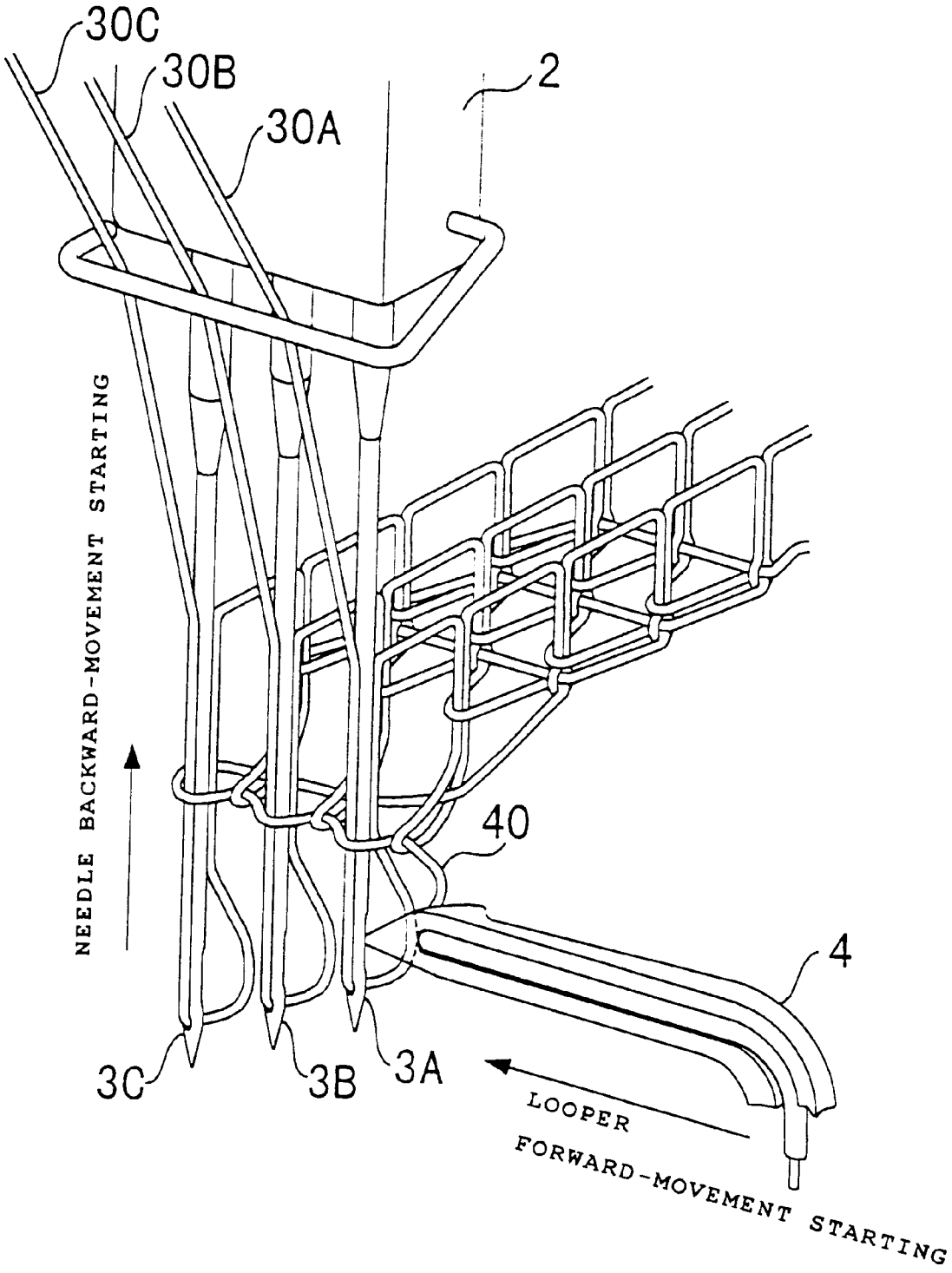
FIG. 18 is a second drawing showing a sewing operation of a cover stitch sewing machine according to the present invention.
Figure 19:
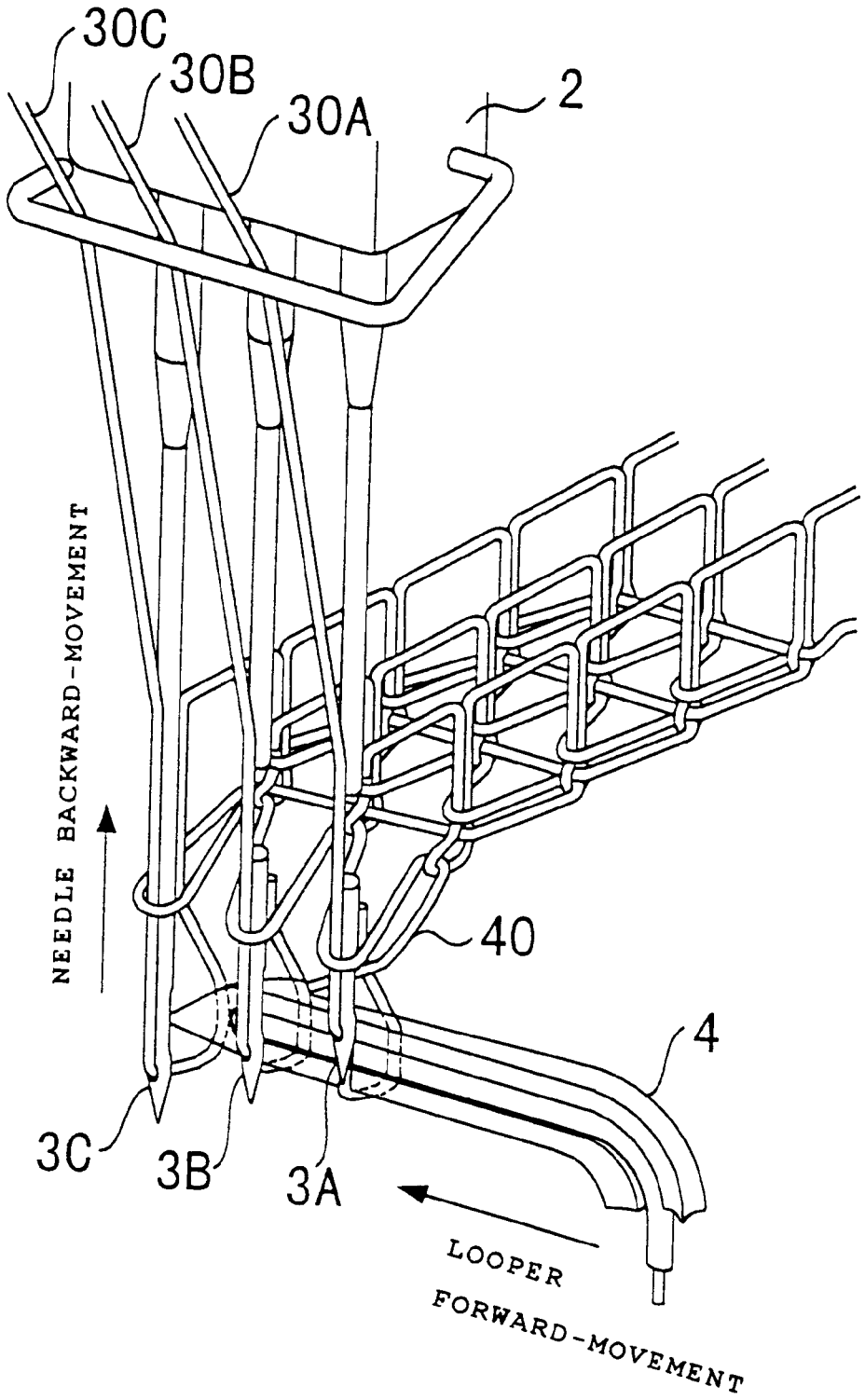
FIG. 19 is a third drawing showing a sewing operation of a cover stitch sewing machine according to the present invention.

When the three needles 3A, 3B, 3C in this condition start moving back, the needle threads 30A, 30B, 30C passed through the same needles are held on the upper surface of the needle plate by the needles 3A, 3B, 3C and fabrics through which the needles are passed, and remain in the position with the three needles 3A, 3B, 3C without being lifted as shown in FIG. 18, to form needle thread loops behind the needle points. Since the looper 4 advances in a region behind the needle points as it crosses the three needles 3A, 3B, 3C in accordance with the upward movements thereof, the tip 4a of the looper 4 hooks the above-mentioned needle thread loops in order from the nearest thread loop to hang the needle threads 30A, 30B, 30C on the looper 4. During this time, with the needle threads 30A, 30B, 30C connected to the cover stitch sewn fabrics and hung on the looper 4 the fabrics are sewn, so that they are not drawn by the looper 4 in the direction of advancement thereof.

Figure 20:
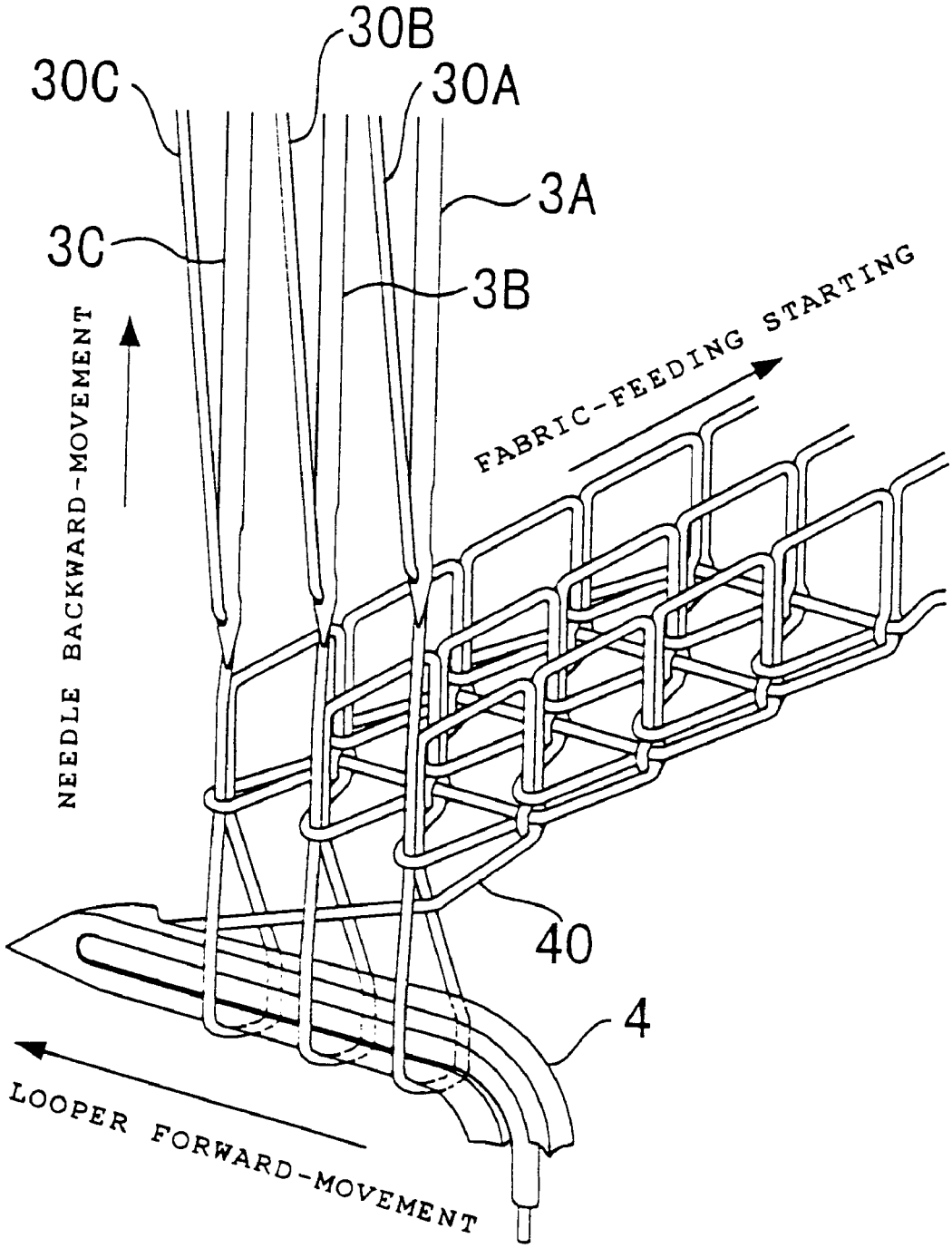
FIG. 20 is a fourth drawing showing a sewing operation of a cover stitch sewing machine according to the present invention.

When the needles 3A, 3B, 3C continue to move back, the looper thread 40 intertwined therewith leave the same needles, and are tightened by the forwardly moving looper 4 as shown in FIG. 20, and the needle threads 30A, 30B, 30C hung on the looper 4 are also tightened by the needle thread take-up (not shown). Accordingly, the stitches can be tightened.

Figure 21:
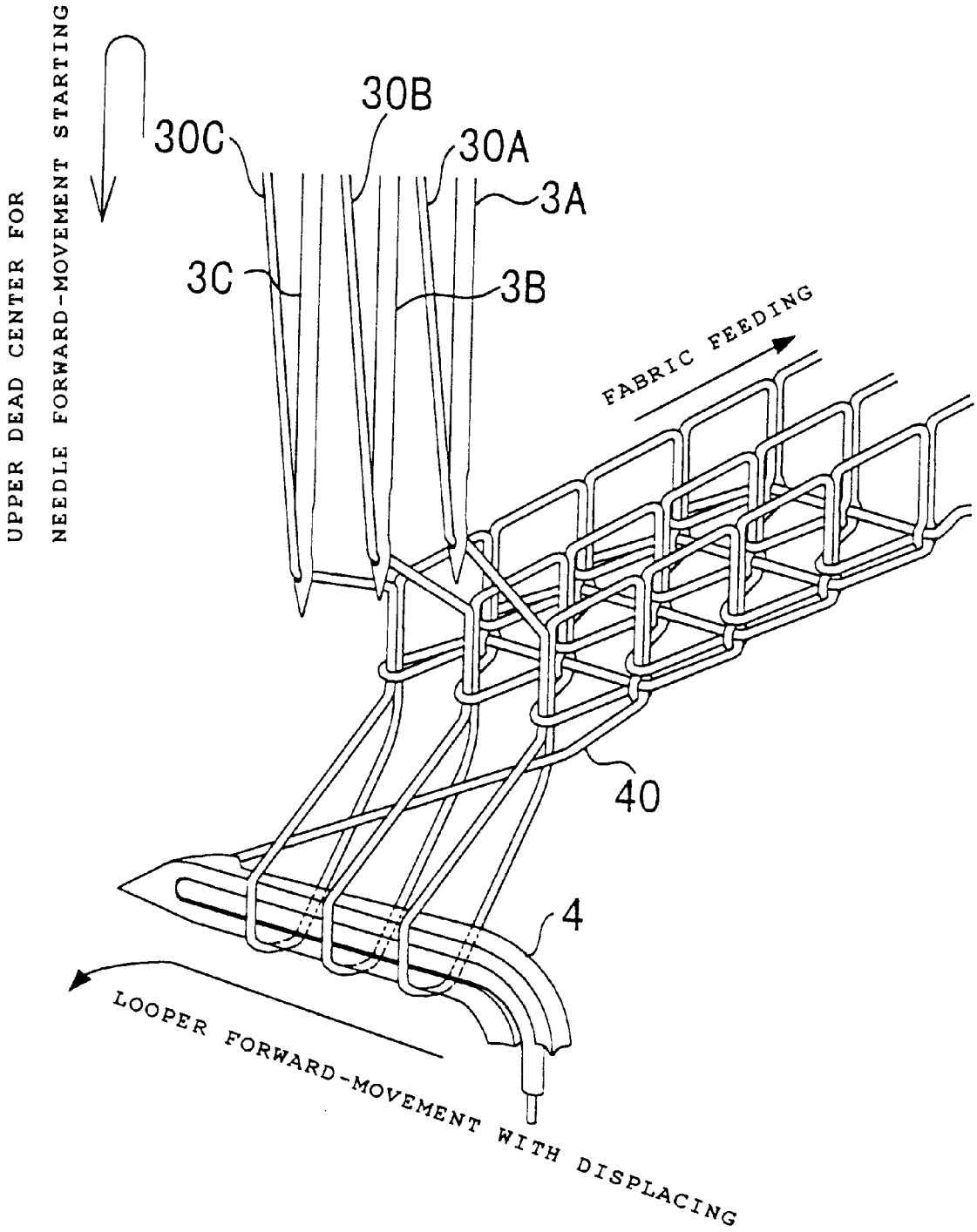
FIG. 21 is a fifth drawing showing a sewing operation of a cover stitch sewing machine according to the present invention.

When the needles 3A, 3B, 3C move back from the needle plate 6, the front and rear feed dogs 5A, 5B project from the feed dog windows 6A, 6B to start feeding fabrics while holding the fabrics in cooperation with the pressure foot 7, and the looper 4 starts being displaced in the direction opposite to the fabric feeding direction as shown in FIG. 21.

When the looper 4 thereafter moves forward, and is displaced in the direction opposite to the fabric feeding direction to reach the foremost advancement point, it then starts moving back. At this point in time, the needles 3A, 3B, 3C start moving forward. Before the tip of the needle 3C has reached the fabrics, the fabric feeding operation is stopped.

Figure 22:
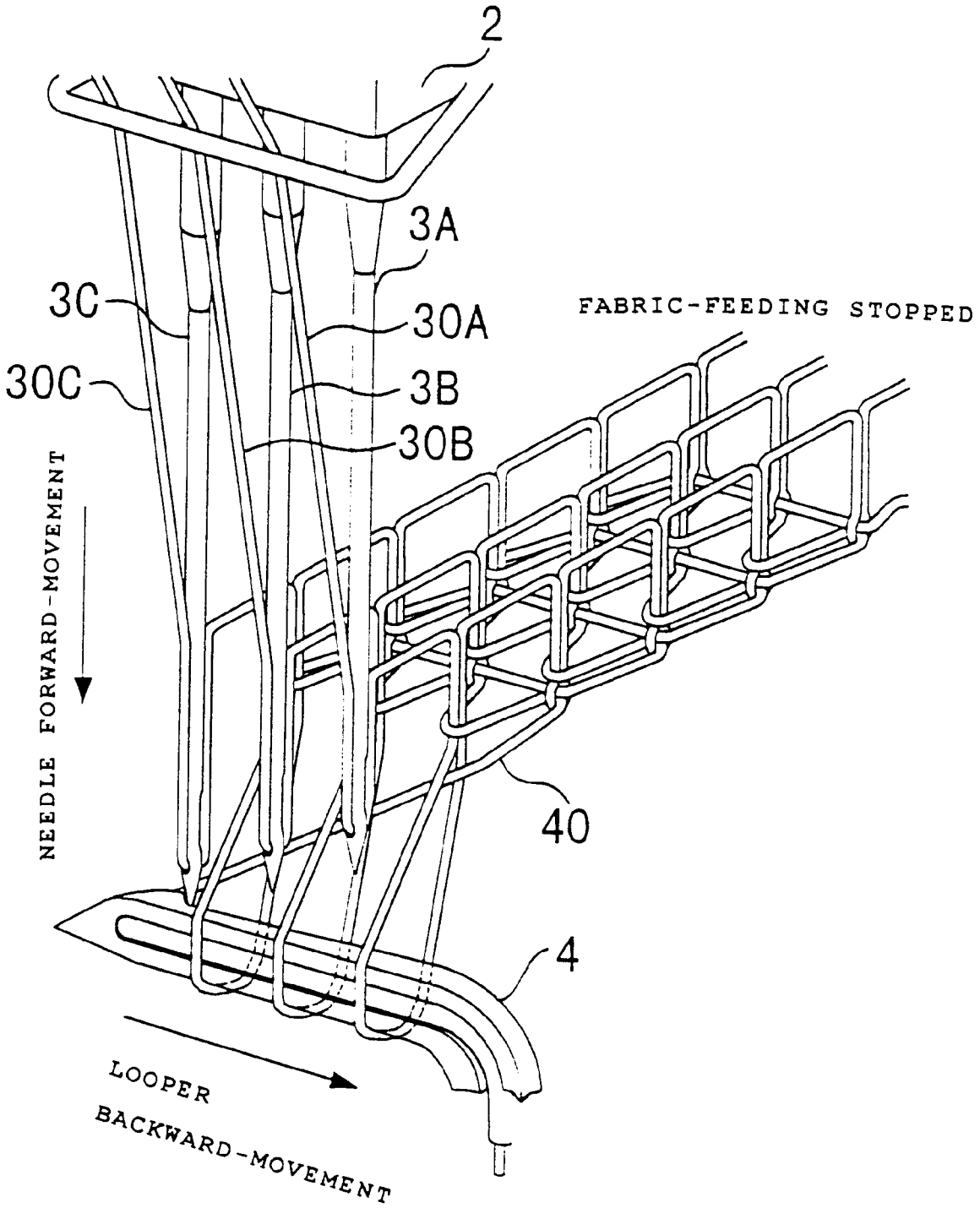
FIG. 22 is a sixth drawing showing a sewing operation of a cover stitch sewing machine according to the present invention.

When the needles 3A, 3B, 3C move forward to pass through the fabrics simultaneously with the backward movement of the looper 4, the looper 4 is positioned ahead of the needle points (on the side of the front feed dogs 5A) as shown in FIG. 22. Consequently, the needles 3A, 3B, 3C pass through triangular thread rings formed by the looper thread 40 and needle threads 30A, 30B, 30C hung on the looper 4, and hook the looper thread 40.

Figure 23:
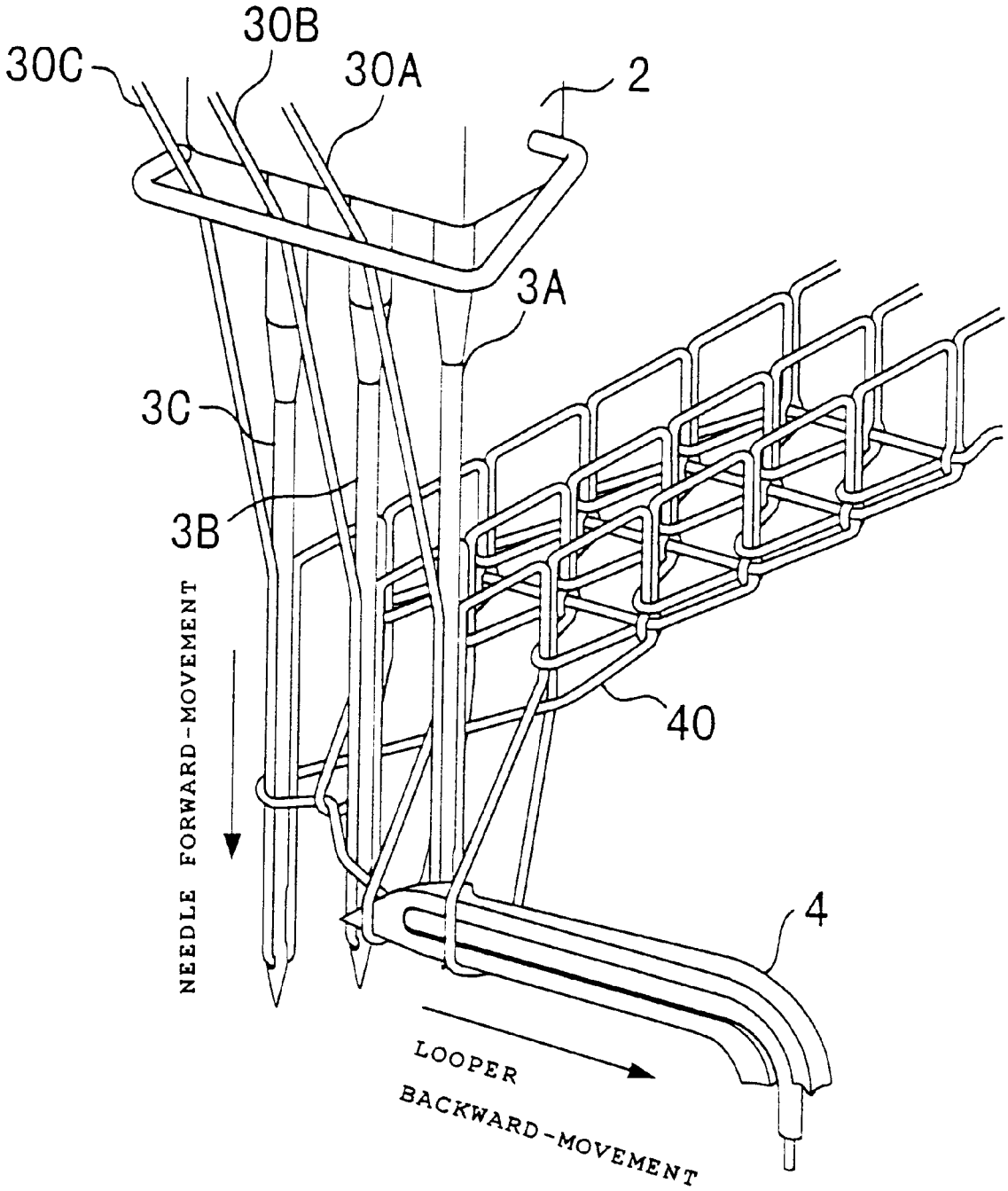
FIG. 23 is a seventh drawing showing a sewing operation of a cover stitch sewing machine according to the present invention.

As shown in FIG. 23, the needles 3A, 3B, 3C finish hooking the looper thread 40, and the needle threads 30A, 30B, 30C hang on the looper 4 come off from the looper 4 due to the backward movement of the looper 4. When the looper 4 further moves in the fabric feeding direction to reach the rearmost retreating point, the needle threads 30A, 30B, 30C are drawn up by the needle thread take-up as shown in FIG. 17, and one cover stitch is formed without having any connection with the thread positioning spreader 10 provided in the bottom portion of the needle plate 6.

When the above-described cover stitch sewing operation is thereafter carried out repeatedly, stitches can be formed continuously in a stable condition.

FIGS. 9, 12 and 14 are sectional views showing the needle 3A alone, in which the illustrations of the other needles 3B, 3C are omitted since they perform the same chain-off stitch sewing operations.

When the three needles 3A, 3B, 3C in this mode of embodiment are a right needle 3A, a central needle 3B and a left needle 3C, the looper 4 moves from the side of the right needle 3A to that of the left needle 3C but the movement of the looper 4 is not limited to this, i.e., the looper 4 may be moved forward from the side of the left needle 3C to that of the right needle 3A. In this case, the direction in which the thread positioning spreader 10 is set has to be changed in accordance with the triangles formed by the looper thread 40 and three needle threads 30A, 30B, 30C.

In this mode of embodiment, the recesses 6C, 6D, 6E provided in the needle plate 6 are formed arcuately but the shape of them is not limited to this, i.e., these recesses may have any shape as long as they can index the threads.

As described above, the chain-off forming apparatus for cover stitch sewing machines according to the present invention is provided with a thread positioning spreader in a bottom portion of the section of a needle plate which is on the rear side of needle points, and this enables the drawing of chain-off's due to the vertical linear reciprocating movements of needles to be prevented, and the sewing of chain-off stitches in a stable condition to be done continuously without being influenced by the arcuate reciprocating movements of a looper. Therefore, a skip stitch and the drawing of chain-off's to a position below the needle plate can be prevented reliably by a simple structure not provided with special devices such as a chain-off thread holder, a loop holder and a thread spreader. Also, the chain-off stitches can be sewn continuously in a stable condition without detecting rear ends of the fabrics by a sensor, and, moreover, without changing the tension of the threads in accordance with the result of the detection.

What is claimed is:

1. A chain-off forming apparatus for cover stitch sewing machines, adapted to introduce double chain stitch chain-off's, which are formed below a needle plate by the intertwining of threads on a plurality of needles and a thread on a looper in accordance with the actions of said needles and said looper occurring when fabrics to be sewn are not fed, onto the portion of an upper surface of said needle plate which is behind needle points, and feed out the chain-off's continuously with the chain-off's held between rear feed dogs on the rear side of the needle points and a chain-off thread gripper, wherein:

said needle plate is provided with a thread positioning spreader which is adapted to engage, in a position behind the needle points while the fabrics to be sewn are not fed, the connected needle threads and looper thread with each other at predetermined intervals when said needles are moved into substantially triangular spaces formed by the looper thread connected to said looper double chain stitches from previously formed on feeding the fabrics to be sewn and needle threads hung on said looper, and which is adapted to have said looper enter the loops formed by the needle threads when said needles are moved back, feed double chain stitch chain-off's, remove the intertwined needle threads from said looper, and maintain the intertwined needle threads and looper thread in an engaged state.

2. A chain-off forming apparatus for cover stitch sewing machines according to claim 1, wherein said thread positioning spreader is formed of retainers having inclined portions indexed to the needle points and provided between recesses of said needle plate.

3. A chain-off forming apparatus for cover stitch sewing machines according to claim 1, wherein the direction in which said thread positioning spreader is set is diagonal with respect to the triangular spaces.

4. A chain-off forming apparatus for cover stitch sewing machines according to claim 1, wherein said needle plate is formed so that the sewn double chain stitch chain-off's are fed out from the side of forward-movement of said looper.

5. A chain-off forming apparatus for cover stitch sewing machines according to claim 1, wherein said chain-off thread gripper is provided with chain-off thread holder dogs for holding the double chain stitch chain-off's between said chain-off thread holder dogs and said needle plate during the formation of the double chain stitches.

* * * * *